US005438554A

United States Patent [19]

Seyed-Bolorforosh et al.

[11] Patent Number: 5,438,554

[45] Date of Patent: Aug. 1, 1995

[54] TUNABLE ACOUSTIC RESONATOR FOR CLINICAL ULTRASONIC TRANSDUCERS

[75] Inventors: Mir S. Seyed-Bolorforosh, Palo Alto; Michael Greenstein, Los Altos, both of Calif.; Turuvekere R. Gururaja, North Andover, Mass.; Henry Yoshida, San Jose, Calif.

[73] Assignee: Hewlett-Packard Company, Palo Alto, Calif.

[21] Appl. No.: 203,216

[22] Filed: Feb. 28, 1994

Related U.S. Application Data

[63] Continuation-in-part of Ser. No. 77,530, Jun. 15, 1993.

[51] Int. Cl.[6] ..... H04R 17/00

[52] U.S. Cl. ..... 367/140; 367/153; 310/320; 310/334; 310/336; 128/662.03; 128/661.01

[58] Field of Search ..... 128/662.03, 660.01, 128/661.01; 367/140, 153; 310/320, 317, 322, 334, 336

[56] References Cited

U.S. PATENT DOCUMENTS

| | | | |
|---|---|---|---|
| 2,589,403 | 3/1952 | Kurie | 171/327 |
| 3,093,760 | 6/1963 | Tarasevich | 310/9.1 |
| 3,378,704 | 4/1968 | Miller et al. | 310/9 |
| 3,401,377 | 9/1968 | Bartlett et al. | 340/173.2 |
| 3,462,746 | 8/1969 | Bartlett | 340/173.2 |
| 3,590,287 | 6/1971 | Berlincourt | 310/8.2 |
| 3,718,898 | 2/1973 | Cook et al. | 340/10 |
| 3,833,825 | 9/1974 | Haan | 310/9.5 |
| 4,087,716 | 5/1978 | Heywang | 310/332 |
| 4,096,756 | 6/1978 | Alphonse | 73/609 |
| 4,211,948 | 7/1980 | Smith et al. | 310/322 |
| 4,356,422 | 10/1982 | van Maanen | 310/322 |
| 4,366,406 | 12/1982 | Smith et al. | 310/334 |
| 4,367,426 | 1/1983 | Kumada et al. | 310/358 |
| 4,672,591 | 6/1987 | Breimesser et al. | 367/152 |
| 4,695,988 | 9/1987 | Banno | 367/154 |
| 4,717,851 | 1/1988 | Fenner et al. | 310/334 |
| 4,736,631 | 4/1988 | Takeuchi et al. | 73/649 |
| 4,835,747 | 5/1989 | Billet | 367/164 |
| 4,939,826 | 7/1990 | Shoup | 310/322 |

(List continued on next page.)

FOREIGN PATENT DOCUMENTS

| | | | |
|---|---|---|---|
| 0401027 | 12/1990 | European Pat. Off. | B60B 1/06 |
| 3430161A1 | 2/1986 | Germany | G10K 11/02 |
| 45-23667 | 8/1970 | Japan | 310/334 |
| 60-208200 | 10/1985 | Japan | H04R 17/00 |
| 2059716B | 7/1983 | United Kingdom | H04R 17/00 |

OTHER PUBLICATIONS

N. Kim, S. J. Jang, and T. R. Shrout; "Relaxor Based Fine Grain Piezoelectric Materials"; Proceedings of the 1990 IEEE International Symposium on Applications of Ferroelectrics; pp. 605–609, 1991.

(List continued on next page.)

*Primary Examiner*—J. Woodrow Eldred

[57] ABSTRACT

A tunable ultrasonic probe includes a body of a first piezoelectric material acoustically coupled in series with a body of a second piezoelectric material. The second piezoelectric material has a Curie temperature that is substantially different than that of the first piezoelectric material. Preferably, the first piezoelectric material is a conventional piezoelectric ceramic, such as lead zirconate titanate, while the second piezoelectric material is a relaxor ferroelectric ceramic, such as lead magnesium niobate. At an operating temperature of the probe, the first piezoelectric material has a fixed polarization. In contrast, the second piezoelectric material has a polarization that is variable relative to the fixed polarization of the first piezoelectric material. A preferred novel arrangement of electrodes electrically couples the bodies in parallel with one another. An oscillating voltage for exciting the acoustic signals in the probe is coupled with the electrodes. The polarization of the second piezoelectric material is variably controlled by a bias voltage coupled with the electrodes. In a preferred embodiment, the bias voltage has a reversible electrical polarity for selecting one resonant frequency from a plurality of resonant frequencies of the probe. In another preferred embodiment, the bias voltage source has a variable voltage level for selecting at least one of a plurality of resonant frequencies of the probe.

20 Claims, 19 Drawing Sheets

U.S. PATENT DOCUMENTS

| | | | |
|---|---|---|---|
| 5,025,790 | 6/1991 | Dias | 128/662 |
| 5,045,746 | 9/1991 | Wersing et al. | 310/334 |
| 5,099,459 | 3/1992 | Smith | 367/153 |
| 5,115,809 | 5/1992 | Saitoh et al. | 129/662 |
| 5,142,187 | 8/1992 | Saito et al. | 310/358 |
| 5,175,709 | 12/1992 | Slayton et al. | 367/90 |
| 5,237,542 | 8/1992 | Burke et al. | 367/103 |
| 5,345,139 | 9/1994 | Gururaja et al. | 310/358 |

OTHER PUBLICATIONS

W. Y. Pan, W. Y. Gu, D. J. Taylor and L. E. Cross; "Large Piezoelectric Effect Induced by Direct Current Bias in PMN:PT Relaxor Ferroelectric Ceramics"; Japanese Journal of Applied Physics, vol. 28, No. 4, 1989, pp. 653–661.

Thomas R. Shrout and Joseph Fielding, Jr.; "Relaxor Ferroelectric Materials"; 1990 Ultrasonic Symposium Proceedings, vol. 2, IEEE, 1990, pp. 711–720.

Sixte de Fraguier, Jean-Francois Gelly, Leon Volnrerman and Olivier Lanuzel; "A Novel Acoustic Design for Dual Frequency Transducers Resulting in Separate Bandpass for Color Flow Mapping (CFM)".

Hiroshi Takeuchi, Hiroshi Masuzawa, and Yukio Ito; "Medical Ultrasonic Probe Using Electrostrictive/-Polymer Composite"; 1989 Ultrasonic Symposium Proceedings; IEEE, pp. 705–708.

D. J. Taylor, D. Damjanovic, A. S. Bhalla, and L. E. Cross; "Complex Piezoelectric, Elastic, and Dielectric Coefficient of La-Doped 0.93 $Pb(Mg_{1/3}NB_{2/3})O_3$:0.07 $PbTiO_3$ under DC Bias", Ferroelectrics Letters, 1990, vol. 11, pp. 1–9.

D. J. Taylor, D. Damjanovic, A. S. Bhalla, and L. E. Cross; "Electric Field Dependence of $d_h$ In Lead Magnesium Niobate Lead Titanate Ceramics"; Proceedings of the 1990 IEEE International Symposium on Application of Ferroelectric; pp. 341–345, 1991.

Wallace Arden Smith and Bertram A. Auld; "Modeling 1–3 Composite Piezoelectrics: Thickness-Mode Oscillations"; IEEE Transactions on Ultrasonics, Ferroelectrics, and Frequency Control, vol. 38, No. 1, Jan., 1991, pp. 40–47.

R. E. Newnham, D. P. Skinner and L. E. Cross; "Connectivity and Piezoelectric-Pyroelectric Composites"; Mat. Res. Bull. vol. 13, pp. 525–536.

M. I. Haller and B. T. Khuri-Yakub; "Micromachined Acoustic Matching Layers"; SPIE, vol. 1733, 1992, pp. 72–77.

M. I. Haller and B. T. Khuri-Yakub; "Micromachined Ultrasonic Materials"; 1991 IEEE Ultrasonics Symposium; pp. 403–405.

Peder C. Pedersen, Oleh Tretiak, and Ping He; "Impedance-Matching Properties of an Inhomogeneous Matching Layer with Continuously Changing Acoustic Impedance"; 1982 Acoustical Society of America, vol. 72, No. 2, pp. 327–336.

Erhard K. Sittig; "Transmission Parameters of Thickness-Driven Piezoelectirc Transducers Arranged in Multilayer Configurations"; IEEE Transactions on Sonics and Ultrasonics, vol. SU-14, No. 4, Oct., 1967, pp. 167–174.

Karen Pendergraft and Ronald Piper; "An Exact Solution for a Reflection Coefficient in a medium having an Exponential Impedance profile"; 1993 Acoustical Society of America, vol. 94, No. 1, Jul., 1993, pp. 580–582.

Wallace Arden Smith; "New Opportunities in Ultrasonic Transducers Emerging from Innovations in Piezoelectric Materials"; 1992 SPIE International Symposium, Jul. 1992, pp. 1–24.

TUNABLE ACOUSTIC RESONATOR FOR CLINICAL ULTRASONIC TRANSDUCERS

CROSS REFERENCE TO RELATED APPLICATIONS

This is a continuation in part of application Ser. No. 08/077,530 filed on Jun. 15, 1993, pending.

FIELD OF THE INVENTION

This invention relates to ultrasonic transducers and, more particularly, to tunable ultrasonic transducers.

BACKGROUND OF THE INVENTION

Ultrasonic transducers are used in a wide variety of applications wherein it is desirable to view the interior of an object non-invasively. For example, in medical applications physicians use ultrasonic transducers to inspect the interior of a patient's body without making incisions or breaks in the patient's skin, thereby providing health and safety benefits to the patient. Accordingly, ultrasonic imaging equipment, including ultrasonic probes and associated image processing equipment, has found widespread medical use.

Ultrasonic probes provide a convenient and accurate way of gathering information about various structures of interest within a body being analyzed. In general, the various structures of interest have acoustic impedances that are different than an acoustic impedance of a medium of the body surrounding the structures. In operation, ultrasonic probes generate a signal of acoustic waves that is then acoustically coupled from the probe into the medium of the body so that the acoustic signal is transmitted into the body. As the acoustic signal propagates through the body, part of the signal is reflected by the various structures within the body and then received by the ultrasonic probe. By analyzing a relative temporal delay and intensity of the reflected acoustic waves received by the probe, a spaced relation of the various structures within the body and qualities related to the acoustic impedance of the structures can be extrapolated from the reflected signal.

For example, medical ultrasonic probes provide a convenient and accurate way for a physician to collect imaging data of heart tissue or fetal tissue structures within a body of a patient. In general, the heart or fetal tissues of interest have acoustic impedances that are different than an acoustic impedance of a fluid medium of the body surrounding the tissue structures. In operation, such a medical probe generates a signal of acoustic waves that is then acoustically coupled from a front portion of the probe into the medium of the patient's body, so that the signal is transmitted into the patient's body. Typically, this acoustic coupling is achieved by pressing the front portion of the probe into contact with a surface of the abdomen of the patient.

As the acoustic signal propagates through the patient's body, portions of the signal are weakly reflected by the various tissue structures within the body and received by the front portion of the ultrasonic medical probe. As the weakly reflected acoustic waves propagate through the probe, they are electrically sensed by electrodes coupled thereto. By analyzing a relative temporal delay and intensity of the weakly reflected waves received by the medical probe, imaging system components that are electrically coupled to the electrodes extrapolate an image from the weakly reflected waves to illustrate spaced relation of the various tissue structures within the patient's body and qualities related to the acoustic impedance of the tissue structures. The physician views the extrapolated image on a display device coupled to the imaging system.

Since the acoustic signal is only weakly reflected by the tissue structures of interest, it is important to try to provide efficient acoustic coupling between the front portion of probe and the medium of the patient's body. Such efficient acoustic coupling would insure that strength of the acoustic signal generated by the probe is not excessively diminished as the signal is transmitted from the front portion of the probe into the medium of the body. Additionally, such efficient acoustic coupling would insure that strength of the weakly reflected signal is not excessively diminished as the reflected signal is received by the front portion of the probe from the medium of the body. Furthermore, such efficient acoustic coupling would enhance operational performance of the probe by reducing undesired reverberation of reflected acoustic signals within the probe.

An impediment to efficient acoustic coupling is an acoustic impedance mis-match between an acoustic impedance of piezoelectric materials of the probe and an acoustic impedance of the medium under examination by the probe. For example, one piezoelectric material typically used in ultrasonic probes is lead zirconate titanate, which has an acoustic impedance of approximately $33 * 10^6$ kilograms/meter $^2$second, kg/m $^2$s. The acoustic impedance of lead zirconate titanate is poorly matched with an acoustic impedance of human tissue, which has a value of approximately $1.5 * 10^6$ kg/m $^2$s.

Furthermore, since the human body is not acoustically homogeneous, different frequencies of operation of an ultrasonic probe are desirable, depending upon which structures of the human body are serving as an acoustic transmission medium and which structures are the target to be imaged. Many commercially available ultrasonic probes include a transducer array that is optimized for use at only one particular acoustic frequency. Accordingly, when differing applications require the use of different ultrasonic frequencies, a user typically selects a probe which operates at or near a desired frequency from a collection of different probes. Complexity and cost of the ultrasonic imaging equipment is increased because a variety of probes, each having a different operating frequency, is needed. An economical and reliable alternative to manually coupling different transducers to such imaging systems is needed. Automated electrical switching systems have been explored but they have been too costly and complex to provide efficient electrical coupling of probe control lines to imaging system components.

Previously known dual frequency ultrasonic transducers utilize a transducer with a relatively broad resonance peak. Desired frequencies are selected by filtering. Current commercially available dual frequency transducers typically have limited bandwidth ratios, such as 2.0/2.5 MHz or 2.7/3.5 MHz. Graded frequency ultrasonic sensors that compensate for frequency downshifting in the body are disclosed in U.S. Pat. No. 5,025,790, issued Jun. 25, 1991 to Dias. Dual frequency ultrasonic transducers can additionally provide for added flexibility in "color flow" mapping wherein a first frequency is used for conventional echo-amplitude imaging and a second frequency is used for doppler shifted flow imaging.

Probes currently in use, such as those mentioned above, typically include an acoustic impedance matching layer adhesively bonded to the transducer for improving acoustic coupling between the transducer and an object under examination, such as human tissue. The layer matches the acoustic impedance of the transducer to the acoustic impedance of human tissue. However, such previously known acoustic coupling improvement schemes have had only limited success and have created additional manufacturing, reliability and performance difficulties. For example, many previously known impedance matching layers are frequency selective, so as to correctly match the transducer impedance to the impedance of human tissue only over a narrow band of frequencies. Therefore, such previously known impedance matching layers act as filters, further limiting usable bandwidth of a probe.

Furthermore, any unnecessary adhesive bonding should be minimized. Manufacturing difficulties are created by adhesive bonding processes used to implement previously known impedance matching schemes. For example, care must be taken to insure that no voids or air pockets are introduced to any adhesive layer that would impair operation of the probe. Additionally, if the adhesive layer is not acoustically transparent, operational performance is limited at higher acoustic signal frequencies, such as frequencies above 20 megahertz.

What is needed is a tunable ultrasonic probe that provides efficient electrical coupling to imaging system components, while further providing efficient acoustic coupling to the desired medium under examination by the probe.

SUMMARY OF THE INVENTION

A tunable ultrasonic probe of the present invention provides efficient acoustic coupling to a desired medium under examination by the probe and further provides for efficient electrical coupling of probe control lines to imaging system components. Furthermore, the present invention is not limited by manufacturing and performance difficulties associated with previously known acoustic coupling improvement schemes that employ adhesive cements to bond acoustic matching layers to piezoelectric ceramics.

Briefly and in general terms, the ultrasonic probe of the present invention employs a transducer element that includes a body of a first piezoelectric material acoustically coupled in series with a body of a second piezoelectric material. It is preferred that the first and second piezoelectric materials each have intrinsic acoustic impedances that are approximately the same. Preferably, a plurality of the transducer elements are arranged in a phase steerable array.

The second piezoelectric material has a Curie temperature that is substantially different than that of the first piezoelectric material. Preferably, the first piezoelectric material is a conventional piezoelectric ceramic, such as lead zirconate titanate, while the second piezoelectric material is a relaxor ferroelectric ceramic, such as lead magnesium niobate. Preferably, the relaxor ferroelectric ceramic is a modified relaxor ferroelectric ceramic, doped to have a Curie temperature within a range of zero degrees celsius to sixty degrees celsius. At an operating temperature of the probe the first piezoelectric material has a fixed polarization. In contrast, the second piezoelectric material has a polarization that is variable relative to the fixed polarization of the body of the first piezoelectric material.

A preferred novel arrangement of electrodes electrically couples the bodies in parallel with one another. An oscillating voltage for exciting the acoustic signals in the probe is coupled with the electrodes. The polarization of the second piezoelectric material is variably controlled by a bias voltage coupled with the electrodes.

In a preferred embodiment, the bias voltage has a reversible electrical polarity for selecting one resonant frequency from a plurality of resonant frequencies of the probe. In another preferred embodiment, the bias voltage has a variable voltage level for selecting at least one of a plurality of resonant frequencies of the probe.

The body of the first piezoelectric material has a first face and an opposing face. Similarly, the body of the second piezoelectric material has a first face and an opposing face. The preferred novel arrangement of electrodes includes a first electrode layer contacting the first face of the body of the first piezoelectric material and contacting the first face of the body of the second piezoelectric material. The preferred arrangement of electrodes also includes a second electrode layer sandwiched between the opposing face of the body of the first piezoelectric material and the opposing face of the body of the second piezoelectric material. Accordingly, in the preferred embodiment, each transducer element is controlled using only two electrical connections to each element. The preferred arrangement of electrodes advantageously provides for efficient electrical coupling of probe control lines to imaging system components.

Integral with the first face of the body of the first piezoelectric material is a piezoelectric ceramic layer portion of the body. The body of first piezoelectric material further comprises a bulk remainder portion of piezoelectric ceramic material contiguous with the piezoelectric ceramic layer. The layer and the remainder each have a respective acoustic impedance. In the preferred embodiment, the acoustic impedance of the piezoelectric ceramic layer is controlled at a plurality of tunable resonant frequencies of the probe so as to substantially provide a desired acoustic impedance match between an acoustic impedance of the medium under examination by the probe and the bulk remainder portion of the body of the first piezoelectric material. By providing the acoustic impedance match, the piezoelectric layer helps to provide efficient acoustic coupling between the probe and the medium under examination by the probe.

The piezoelectric ceramic layer includes shallow grooves disposed on the first face of the body of the first piezoelectric material and extending through a thickness of the piezoelectric layer. More specifically, the shallow grooves are micro-grooves, typically extending into the first face of the body less than a thousand microns. In general, a depth dimension of the shallow grooves is selected to be approximately a quarter wavelength of the acoustic signals. A groove volume fraction of the piezoelectric layer is selected to control acoustic impedance of the piezoelectric layer so as to provide the desired acoustic impedance match. In an illustrative medical imaging application, each groove has a respective volume selected so that the piezoelectric layer substantially provides the desired acoustic impedance match between an acoustic impedance of a medium of a patient's body and the bulk remainder portion of the body of the first piezoelectric material. The first electrode layer extends into and contacts the grooves to provide an efficient electrical coupling to the transducer element.

Design parameters such as the width and pitch dimensions of the grooves are adjusted as needed so that for an electrical potential difference measurable between the respective electrode pairs of each array element, there is a relatively small electrical potential difference along the thickness of the respective piezoelectric layer of each element. For example, the width and pitch dimensions of the grooves are selected so that there is a relatively small electrical potential difference along the thickness of the piezoelectric layer that is less than approximately 5% of the electrical potential difference measurable between the pair of electrodes. Because the electrical potential difference along the thickness of the piezoelectric layer is relatively small, the dielectric constant measurable between the electrodes of the element is relatively high and is substantially the same as that which is intrinsic to the ceramic material of the element. Furthermore, the relatively small electrical potential difference along the thickness of the piezoelectric layer insures that the piezoelectric layer is substantially electromechanically inert.

A manufacturing advantage associated with the present invention is that the grooves can be easily etched or cut into a wide range of piezoelectric materials to provide control over groove shape and groove dimensions. It should be understood that the grooves could be disposed on the surface of the body of the second piezoelectric material, just as the grooves are disposed on the first surface of the body of the first piezoelectric. Furthermore, because the inert piezoelectric layer is integral with the transducer element, the present invention provides impedance matching without being burdened by manufacturing problems that are associated with adhesively bonding matching layers to piezoelectric ceramics. Other aspects and advantages of the present invention will become apparent from the following detailed description, taken in conjunction with the accompanying drawings, illustrating by way of example the principles of the invention.

DETAILED DESCRIPTION OF PREFERRED EMBODIMENTS

Figure 1A:
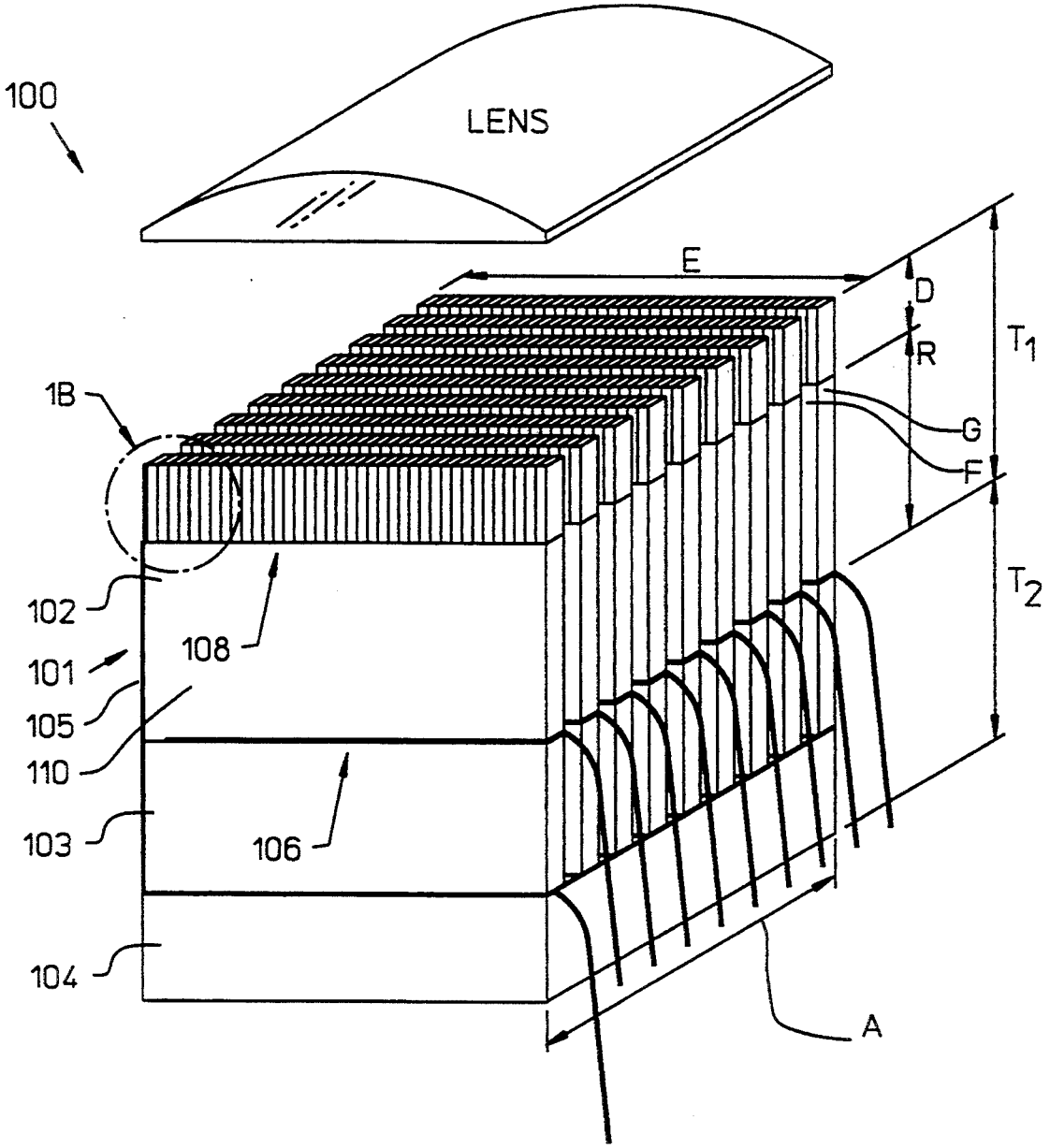
FIG. 1A shows a perspective view of a tunable ultrasonic probe of a preferred embodiment of the present invention.

The tunable ultrasonic probe of the present invention provides efficient coupling of an acoustic signal between the probe and the desired medium under examination, and further provides manufacturing, reliability and performance advantages. FIG. 1A is a simplified perspective view illustrating a preferred embodiment of the ultrasonic probe 100. As shown, the preferred embodiment of the ultrasonic probe includes a phase steerable array of transducer elements 101. Each transducer element includes a respective body of a first piezoelectric material 102 acoustically coupled in series with a respective body of a second piezoelectric material 103.

Each array element has an elevational dimension, E, corresponding to an elevational aperture of the probe. Elevational aperture and the resonant acoustic frequency of each element are selected based on a desired imaging application. Typically, the elevational dimension, E, is selected to be between 7 and 15 wave lengths of the resonant acoustic frequency of the probe. As shown, the transducer elements are arranged in a suitable spaced apart relation, F, along an azimuthal dimension, A, of the array and are supported by a damping support body 104 of epoxy or other appropriate backing material. The damping support body is acoustically coupled in series with the body of the second piezoelectric material for damping unwanted acoustic signals and for drawing unwanted heat away from the body of the second piezoelectric material.

As shown, each element has a suitably selected lateral dimension, G. Furthermore, a number of elements in the array is selected based on requirements of the imaging application. For example, an ultrasonic abdominal probe for a medical imaging application typically includes more than 100 elements and an elevational aperture of 10 wave lengths. For the sake of simplicity, far fewer elements are shown in the probe of FIG. 1A.

The second piezoelectric material has a Curie temperature that is substantially different than that of the first piezoelectric material. Preferably, the first piezoelectric material is a conventional piezoelectric ceramic, for example Lead Zirconate Titanate, PZT, or Barium Titanate, $BaTiO_3$. Such conventional piezoelectric ceramics are characterized by Curie temperatures that are substantially above an operating temperature of the probe. For example, PZT has a Curie temperature that is approximately 200 degrees celsius. Accordingly, polarization of the first piezoelectric ceramic is fixed at the operating temperature of the probe.

In contrast, the second piezoelectric material has a polarization that is variable relative to the fixed polarization of the body of the first piezoelectric material. The second piezoelectric material has a Curie temperature that is substantially below that of the first piezoelectric material. Because regulatory agencies such as the Food and Drug Administration prohibit patient contact with transducers operating at high temperatures, it is preferred that the second piezoelectric material has a Curie temperature below sixty degrees celsius.

Accordingly, the operating temperature of the probe is controlled, with operation near room temperature being preferred.

Preferably, the second piezoelectric material is a relaxor ferroelectric ceramic that is doped to have a Curie temperature within a range of approximately zero degrees Celsius to approximately sixty degrees Celsius. Such doped relaxor ferroelectric ceramics are preferred because they advantageously provide a relatively high dielectric constant while providing a desirable Curie temperature that is near a typical room temperature of twenty five degrees Celsius. Accordingly, relaxor ferroelectric ceramics having a Curie temperature within a range of approximately 25 degrees celsius to approximately 40 degrees celsius are particularly desirable.

Various doped or "modified" relaxor ferroelectric ceramics are known, such as those discussed in "Relaxor Ferroelectric Materials" by Shrout et al., Proceedings of 1990 Ultrasonic Symposium, pp. 711–720, and in "Large Piezoelectric Effect Induced by Direct Current Bias in PMN; PT Relaxor Ferroelectric Ceramics" by Pan et al., Japanese Journal of Applied Physics, Vol. 28, No. 4, April 1989, pp. 653–661. Because these articles provide helpful supportive teachings, they are incorporated herein by reference. A doped or "modified" relaxor such as modified Lead Magnesium Niobate, $Pb(Mg_{\frac{1}{3}}Nb_{\frac{2}{3}})O_3$-$PbTiO_3$, also known as modified PMN or PMN-PT, is preferred. However, other relaxor ferroelectric ceramics such as Lead Lanthanum Zirconate Titanate, PLZT, may be used with beneficial results.

Figure 2:
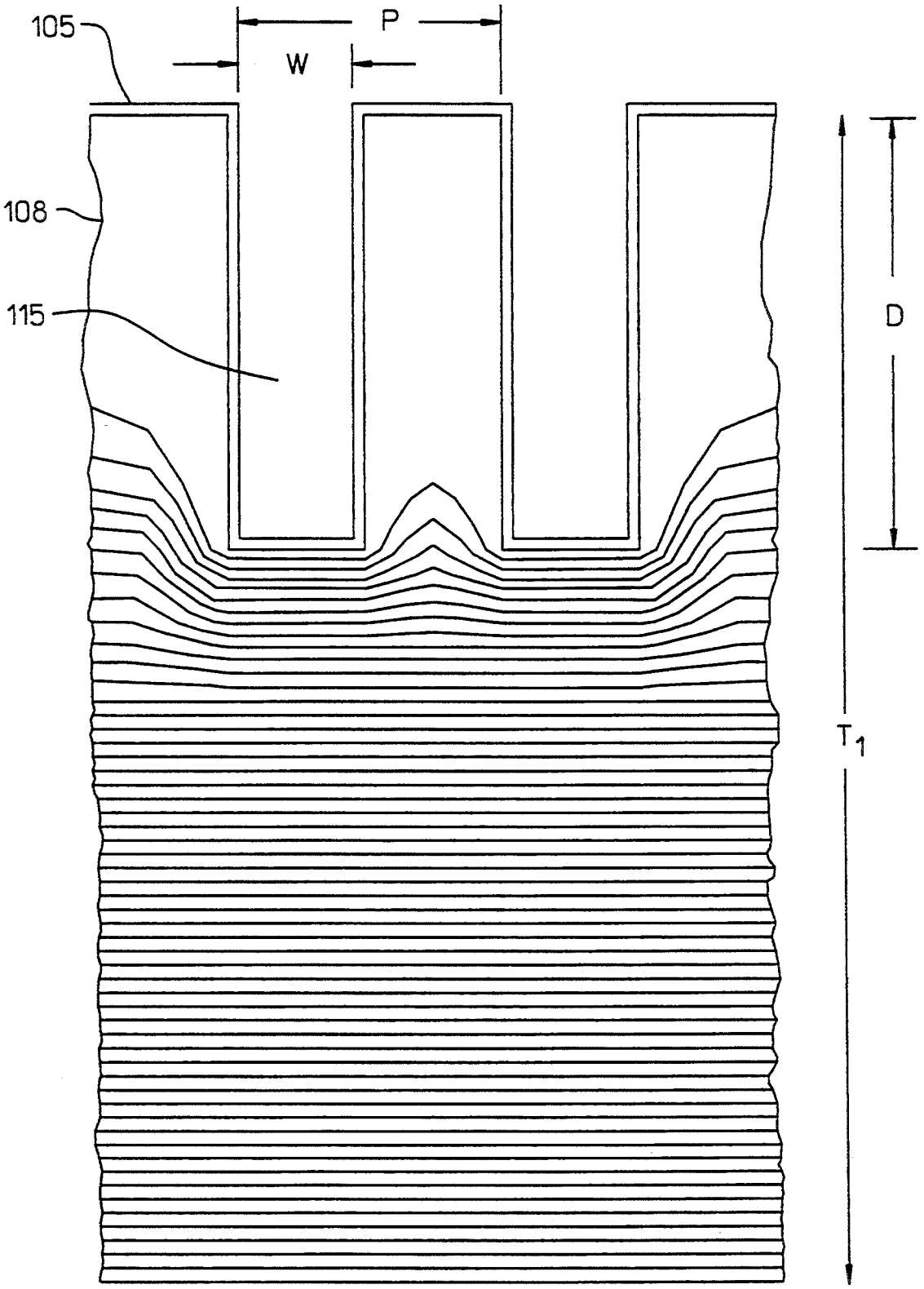
FIG. 2 is a diagram illustrating lines of electric equipotential distributed along a longitudinal dimension of a transducer element of the probe of FIG. 1A.

FIG. 2 of the Shrout article is particularly helpful since it shows a phase diagram having a desired pseudocubic region for particular mole (x) PT concentrations and particular Curie temperatures of a $(1-x)Pb(Mg_{\frac{1}{3}}Nb_{\frac{2}{3}})O_3$-$(x)PbTiO_3$) solid solution system. FIG. 8 of the Shrout article is also particularly helpful since it shows dielectric constant and Curie temperature of various alternative compositionally modified PMN ceramics. Among these alternatives, those doped with $Sc^{+3}$, $Zn^{+2}$, or $Cd^{+2}$ and having a Curie temperature within a range of approximately zero degrees Celsius to approximately sixty degrees Celsius are preferred.

In the present invention, electrodes electrically couple the piezoelectric bodies in parallel with one another. The body of the first piezoelectric material has a first face and an opposing face oriented approximately parallel to one another and being oriented approximately perpendicular to a first thickness dimension, $T_1$, of the body of the first piezoelectric material, as shown in FIG. 1A. Similarly, the body of the second piezoelectric material has a first face and an opposing face oriented approximately parallel to one another and being oriented approximately perpendicular to a second dimension, $T_2$, of the body of the second piezoelectric material. A novel arrangement of electrodes includes a first electrode layer 105 having a modified "c" shape that partially wraps around the transducer element so as to contact the first face of the body of the first piezoelectric material and further contact the first face of the body of the second piezoelectric material. The preferred novel arrangement of electrodes includes a second electrode layer 106 sandwiched between the opposing face of the body of the first piezoelectric material and the opposing face of the body of the second piezoelectric material. In the preferred embodiment, each element is controlled using only two electrical connections to each element. The novel arrangement of electrodes advantageously provides for efficient electrical coupling of probe control lines to imaging system components.

Integral with the first face of the body of the first piezoelectric material is a piezoelectric ceramic layer portion 108 of the body. The piezoelectric layer is substantially electromechanically inert. The body of first piezoelectric material further comprises a bulk remainder portion 110 of the first piezoelectric ceramic material contiguous with the piezoelectric ceramic layer. The respective bulk remainder portion is electromechanically active and resonates along a bulk remainder dimension, R, shown in FIG. 1A.

As shown in detailed view 1B, the piezoelectric ceramic layer includes grooves 115 disposed on the first face of the body of the first piezoelectric material and extending through a thickness, D, of the piezoelectric layer 108. In the preferred embodiment, the grooves are arranged substantially parallel to one another along the respective elevational dimension, E, of each element.

The layer and the remainder each have a respective acoustic impedance. The acoustic impedance of the piezoelectric ceramic layer is controlled at a plurality of tunable resonant frequencies of the probe so as to substantially provide a desired acoustic impedance match between an acoustic impedance of the medium under examination by the probe and the bulk remainder portion of the body of the first piezoelectric material. By providing the acoustic impedance match, the piezoelectric layer helps to provide efficient acoustic coupling between the probe and the medium under examination by the probe.

A groove volume fraction of the piezoelectric layer is selected to control acoustic impedance of the piezoelectric layer so as to provide the desired acoustic impedance match. In an illustrative medical imaging application, each groove has a respective volume selected so that the piezoelectric layer substantially provides the desired acoustic impedance match between an acoustic impedance of a medium of a patient's body and the bulk remainder portion of the body of the first piezoelectric material.

Figure 1B:
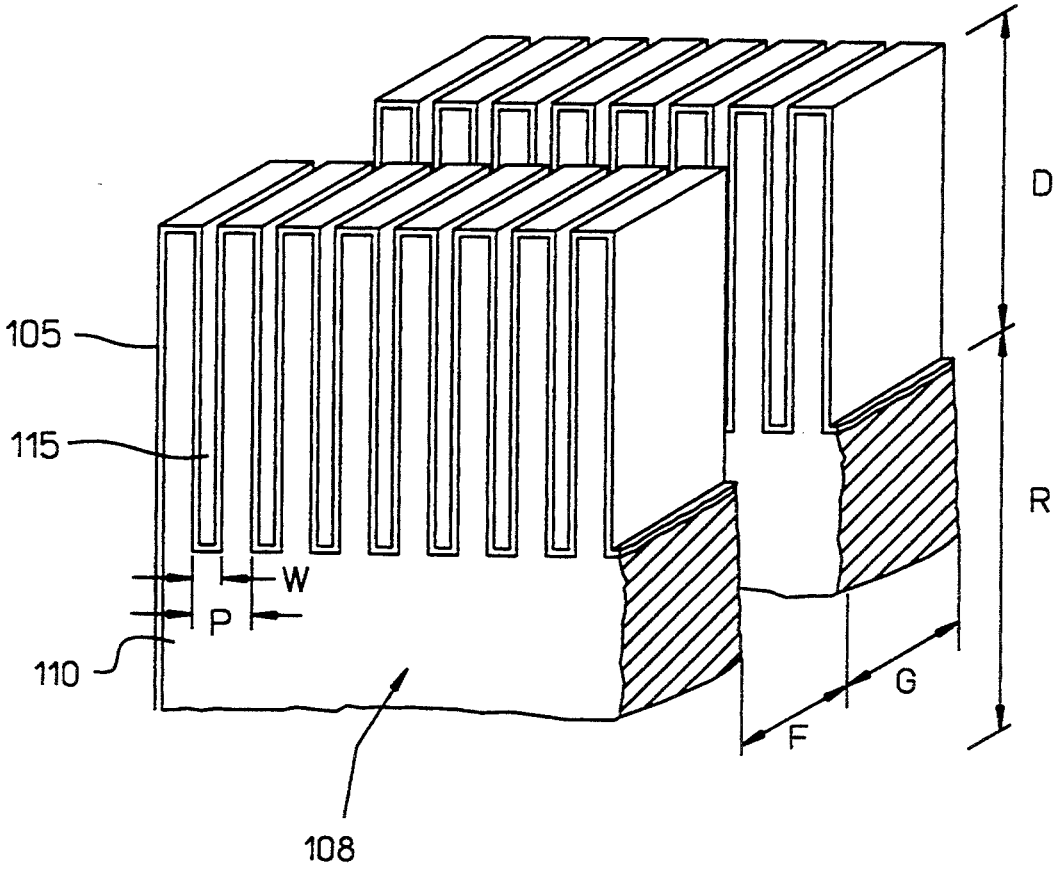
FIG. 1B shows a detailed cut away perspective view of the probe of FIG. 1A.

As shown in detail in FIG. 1B, the first electrode layer 105 extends into and contacts the grooves to provide an efficient electrical coupling to the transducer element. A conformal material, preferably air, is disposed within the grooves adjacent to each electrode. As will be discussed in greater detail later herein, a suitable alternative conformal material, for example polyethylene, may be used instead of air. The selected conformal material has an acoustic impedance, $Z_{conformal}$, associated therewith.

A respective oscillating voltage is applied to the respective pair of electrodes coupled to each transducer element to produce acoustic signals. In general, the first piezoelectric material is characterized by a first acoustic velocity of the acoustic signals as they propagate through the bulk remainder portion the body of the first piezoelectric material. The second piezoelectric material is characterized by a second acoustic velocity of the acoustic signals as they propagate through the body of the second piezoelectric material. The second acoustic velocity is approximately the same as the first acoustic velocity. The first piezoelectric material has a first intrinsic acoustic impedance and the second piezoelectric material is has a second intrinsic acoustic impedance. The second intrinsic acoustic impedance is approximately the same as the first intrinsic acoustic impedance.

The acoustic signals are supported in propagation along each transducer element by longitudinal resonance modes of the each element. The respective acoustic signals produced by each transducer element of the array are emitted together from the inert piezoelectric layer as an acoustic beam that is transmitted into the medium of the body under examination. For example, in the medical imaging application, the acoustic beam is transmitted into patient's body. Phasing of the respective oscillating voltage applied to each element of the array is controlled to effect azimuthal steering of the acoustic beam as the acoustic beam sweeps though the body. An acoustic lens, shown in exploded view in FIG. 1A, is acoustically coupled to provide elevational focussing of the acoustic beam.

As the acoustic signals propagate through the patient's body, portions of the signal are weakly reflected by the various tissue structures within the body, are received by the transducer elements, and are electrically sensed by the respective pair of electrodes coupled to each transducer element. The reflected acoustic signals are first received by the respective inert piezoelectric layer integral with each transducer element and then propagate along the respective longitudinal dimension of each transducer element. Accordingly the acoustic signals propagate through the inert piezoelectric layer with a velocity, and then propagate through the bulk remainder portion of the body of the first piezoelectric material with another velocity. It is preferred that the depth dimension, D, of the grooves of the inert piezoelectric layer be selected to be approximately a quarter of a wavelength of a lowest frequency acoustic signal traveling through the inert piezoelectric layer. The grooves typically extend into the first face of the body less than a thousand microns.

The depth dimension, D, of the grooves defines thickness of the respective inert piezoelectric layer integral with each of the transducer elements. A depth dimension, D, of each groove and a pitch dimension, P, of the respective grooves are selected to separate lateral and shear resonance modes of the inert piezoelectric layer from undesired interaction with a longitudinal resonance mode of the transducer element. Furthermore, the depth and pitch of the grooves are selected to provide efficient transfer of acoustic energy through the inert piezoelectric layer. Additionally, the depth and pitch of the grooves are selected so that the inert piezoelectric layer appears homogenous to acoustic waves. In general, beneficial results are produced by a pitch to depth ratio, P/D, of less than or equal to approximately 0.4, in accordance with additional groove teachings of the present invention discussed in greater detail later herein. The width and pitch dimensions of the grooves are further adjusted, if needed so that for an electrical potential difference measurable between the respective pair of electrodes of each array element, there is a relatively small electrical potential difference along the thickness of the inert piezoelectric layer. For example, the width and pitch dimensions of the grooves are selected so that there is an electrical potential difference along the thickness of the piezoelectric layer that is less than approximately 5% of the electrical potential difference measurable between the respective pair of electrodes of each element.

Acoustic impedance of the inert piezoelectric layer is controlled so as to provide an acoustic impedance match between the bulk remainder acoustic impedance of each transducer element and an acoustic impedance of the medium under examination by the probe. Accordingly, the inert piezoelectric layer provides for efficient acoustic coupling between the transducer element and the medium under examination. The acoustic impedance of the inert piezoelectric layer is substantially determined by groove volume, which is based upon the depth, width and pitch dimensions of the grooves disposed on the respective front face of each of the transducer elements.

A desired acoustic Impedance of the inert piezoelectric layer, $Z_{layer}$, is calculated to produce an impedance match between the bulk acoustic impedance of the ceramic material of the transducer element, $Z_{PZT}$, and the acoustic impedance of the desired media, $Z_{tissue}$, using an equation:

$$Z_{layer}=(Z_{PZT} * Z_{tissue})^{\frac{1}{2}}$$

For example, given that the acoustic impedance of tissue, $Z_{tissue}$, is $1.5 * 10^8$ kilograms/meter$^2$second, kg/m$^2$s, and that the bulk acoustic impedance of lead zirconate titanate, $Z_{PZT}$, is $33 * 10^6$ kg/m$^2$s, the desired acoustic impedance of the inert piezoelectric layer, $Z_{layer}$, is calculated to be approximately $7 * 10^6$ kg/m$^2$s.

The acoustic impedance of the inert piezoelectric layer is substantially controlled by a groove volume fraction of the inert piezoelectric layer, v. A desired volume fraction, v, is calculated from the respective acoustic impedances of the inert piezoelectric layer, the piezoelectric ceramic material, and the conformal material, using an equation:

$$v=(Z_{PZT}-Z_{layer})/(Z_{PZT}-Z_{conformal})$$

For example, given air as the conformal material having an acoustic impedance, $Z_{conformal}$, of 411 kg/m$^2$s, and given values for the acoustic impedance of the inert piezoelectric layer, $Z_{layer}$, and the bulk acoustic impedance of the ceramic material of the element, $Z_{PZT}$, as articulated previously herein, the desired groove volume fraction of the inert piezoelectric layer, v, is approximately 78.7%.

A desired depth of the grooves, D, is calculated from a speed of sound in the inert piezoelectric layer, $C_{layer}$, and a quarter wavelength of the resonant acoustic frequency, f, of the transducer element, using an equation:

$$D=\tfrac{1}{4}(C_{layer}/f)$$

Given that the desired groove volume fraction of the inert piezoelectric layer is approximately 78.7%, speed of sound in the inert piezoelectric layer, $C_{layer}$, can be estimated as being approximately $3.5 * 10^5$ centimeters/-second. Alternatively the speed of sound in the inert piezoelectric layer can be estimated using more sophisticated methods, such as those based on tensor analysis models of the inert piezoelectric layer. For instance, tensor analysis models discussed in "Modeling 1–3 Composite Piezoelectrics: Thickness-Mode Oscillations", by Smith et. al, pages 40–47 of IEEE Transactions on Ultrasonics, Ferroelectrics, and Frequency Control, Vol. 38, No 1, January 1991, can be adapted to estimate speed of sound in the inert piezoelectric layer. As an example, given speed sound in the inert piezoelectric layer, $C_{layer}$, estimated as $3.5 * 10^5$ centimeters/-second and the desired bulk resonant frequency, f, as 2

MHz, the depth of the grooves, D, is approximately 437.5 microns. Accordingly, the grooves are shown to be micro-grooves, extending into the first face of the body of the first piezoelectric material less than 1000 microns.

A pitch, P, of the grooves is calculated so that the pitch is less than 0.4 of the depth of the grooves:

$$P \leqq (0.4*D)$$

For example, given depth of the grooves, D, of approximately 437.5 microns, pitch of the grooves should be less than or equal to 175 microns.

Width of grooves, W, is calculated based upon the pitch, P, the groove volume fraction, v, and a correction factor, k, using an equation:

$$W = P*v*k$$

A desired value for the correction factor, k, is selected based on connectivity between the inert piezoelectric layer and the conformal material. For the inert piezoelectric layer having grooves arranged as shown in FIGS. 1A and 1B, the layer has 2—2 connectivity with the conformal material and the correction factor, k, is simply 1. In alternative embodiments, the grooves are alternately arranged so that the layer has a different connectivity, yielding a different correction factor. For instance, in an alternative embodiment, the grooves are arranges so that the layer has a 3-1 connectivity with the conformal material, yielding a correction factor, k, of 1.25. As an example, given 2—2 connectivity so that the correction factor, k, is 1, pitch of 175 microns, and groove volume fraction of the inert piezoelectric layer of 78.7%, the width, W, of the grooves is approximately 137.7 microns.

A respective number of members in a set of grooves along the elevational dimension, E, of each transducer element or the array is related to the pitch of the grooves and the elevational aperture of the array. Typically, the respective number of members in the set of grooves along the elevational dimension, E, is approximately between the range of 50 and 200 grooves to produce beneficial impedance matching results. As an example, for a given preferred elevational dimension, E, of 10 wave lengths, a preferred respective number of grooves along the elevational dimension is approximately 100 grooves, For the sake of simplicity, fewer grooves than 100 grooves are shown in FIG. 1A.

For embodiments of the probe scaled to operate at a higher resonant frequencies, relevant groove dimensions are scaled accordingly. For example, for an embodiment of the probe scaled to operate at a resonant acoustic frequency of 20 MHz, relevant groove dimensions of the 2 MHz probe example discussed previously are scaled by a factor of 10. Therefore, for an array of transducer elements resonating at 20 MHz and respective piezoelectric ceramic layers with grooves arranged for 2—2 connectivity, relevant dimensions of the grooves are scaled down by 10 so as to have pitch of 17.5 microns, width of 13.77 microns, and depth of approximately 43.75 microns. Accordingly, the grooves are once again shown to be micro-grooves, extending into the first face of the body of the first piezoelectric material less than 1000 microns.

Electrical boundary requirements are imposed using the first electrode layer that extends into and contact the grooves. Design parameters such as the width and pitch dimensions of the grooves are adjusted as needed so that for an electrical potential difference measurable between the respective electrode pairs of each array element, there is a relatively small electrical potential difference along the thickness of the respective piezoelectric layer of each element. For example, the width and pitch dimensions of the grooves are selected so that there is a relatively small electrical potential difference along the thickness of the piezoelectric layer that is less than approximately 5% of the electrical potential difference measurable between the respective pair of electrodes. It should be understood that for ultrasonic probes, there are several relevant sources of the electrical potential difference measurable between the respective pair of electrodes. For example, one relevant source of the electrical potential difference measurable between the respective pair of electrodes is voltage applied to the electrodes to excite acoustic signals in each piezoelectric ceramic element. Another relevant source of the electrical potential difference measurable between the respective pair of electrodes is voltage induced in each transducer element by weakly reflected acoustic signals received by each element.

The relatively small electrical potential difference is graphically illustrated in FIG. 2. FIG. 2 is a cut away sectional view of one of the transducer elements of FIG. 1A, providing an illustrative diagram showing lines of electrical equipotential distributed along the thickness dimension, $T_1$, of the element for the example of width and depth of grooves 115 discussed previously herein. Lines of equipotential are normal to a first electric field directed along the thickness dimension of the body of the first piezoelectric material. Given an exemplary 1 volt potential measurable between the pair of electrodes, the lines of equipotential shown in FIG. 2 correspond to 0.01 Volt increments in potential. As shown in FIG. 2, there is a relatively small electrical potential difference along the thickness of the piezoelectric layer 108, D, that is only approximately 3% of the electrical potential difference applied to the electrodes of the array elements. Because the electrical potential difference along the thickness of the piezoelectric layer is relatively small as shown in FIG. 2, the dielectric constant measurable between the electrodes of the element is substantially the same as that which is intrinsic to the lead zirconate titanate material of the element, and therefore is relatively high. Furthermore, the relatively small potential difference along the thickness of the piezoelectric layer further helps to insure that the piezoelectric layer is electromechanically inert.

Electrical efficiency of the present invention is achieved using the first electrode layer that extends into and contact the grooves. Capacitive charging of the electrodes is provided by a displacement current, which is linearly proportional to a product of an electric potential measurable between the respective pair of electrodes and the dielectric constant. Accordingly, the relatively high dielectric constant provides a relatively high capacitive charging. The high capacitive charging is desired to drive cabling that electrically couples the electrodes to imaging system components, which analyze a relative temporal delay and intensity of the weakly reflected acoustic signal received by the probe and electrically sensed by the electrodes. The imaging system then extrapolates a spaced relation of the various structures within the body and qualities related to the acoustic impedance of the structures is then extrapolated from the analysis to produce an image of structures within the body.

Similarly, electrical impedance of each element is linearly proportional to the dielectric constant of each element. The relatively high dielectric constant provides a relatively high electrical impedance. The high electrical impedance of each element is desired to provide an improved impedance match to an electrical impedance of the cabling and to an electrical impedance of imaging system components.

Figure 3A:
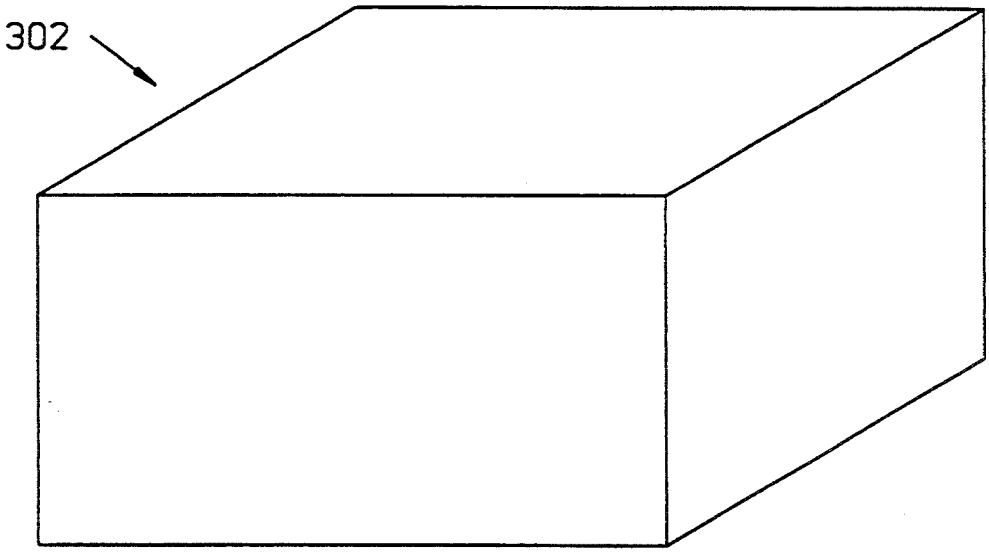
FIGS. 3A–D are perspective views illustrating steps in making the probe of FIG. 1A.
Figure 3B:
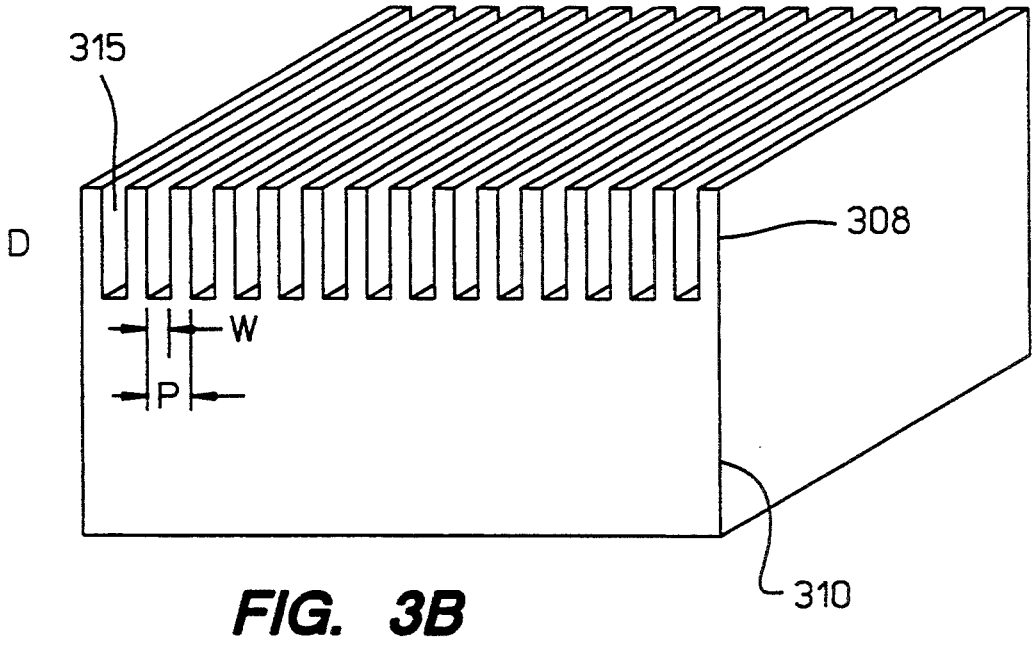

Fabrication, poling, and dicing of the transducer elements of the array are illustrated and discussed with reference to simplified FIGS. 3A–E. An initial step is providing a raw slab 302 of the first piezoelectric material as shown in FIG. 3A. Preferably, this is a raw slab of PZT material. Since the raw material has not yet been poled, there is only random alignment of individual ferroelectric domains within the material and therefore the material is electromechanically inert. As shown in FIG. 3B, the slab includes a inert piezoelectric layer 308 integral with a first face of the slab and further includes a bulk remainder portion 310 of the slab. The inert piezoelectric layer is characterized by grooves 315 having a depth, D, cut into the first face of the slab and extending through a thickness of the layer. The grooves are cut into the slab using a blade of a dicing machine. Width or the blade is selected so that the grooves have the desired width dimension, W. Controls of the dicing machine are set to cut the grooves at the desired pitch, P, and depth, D. Alternatively, photolithographic processes utilizing chemical etching may be employed to etch the grooves into the front surface of the slab at the desired pitch, depth, and width. As another alternative, the grooves can be ablated onto the front face of the slab using a suitable laser. As another alternative, injection molding can be used to form the slab as well as the grooves in the slab.

Figure 3C:
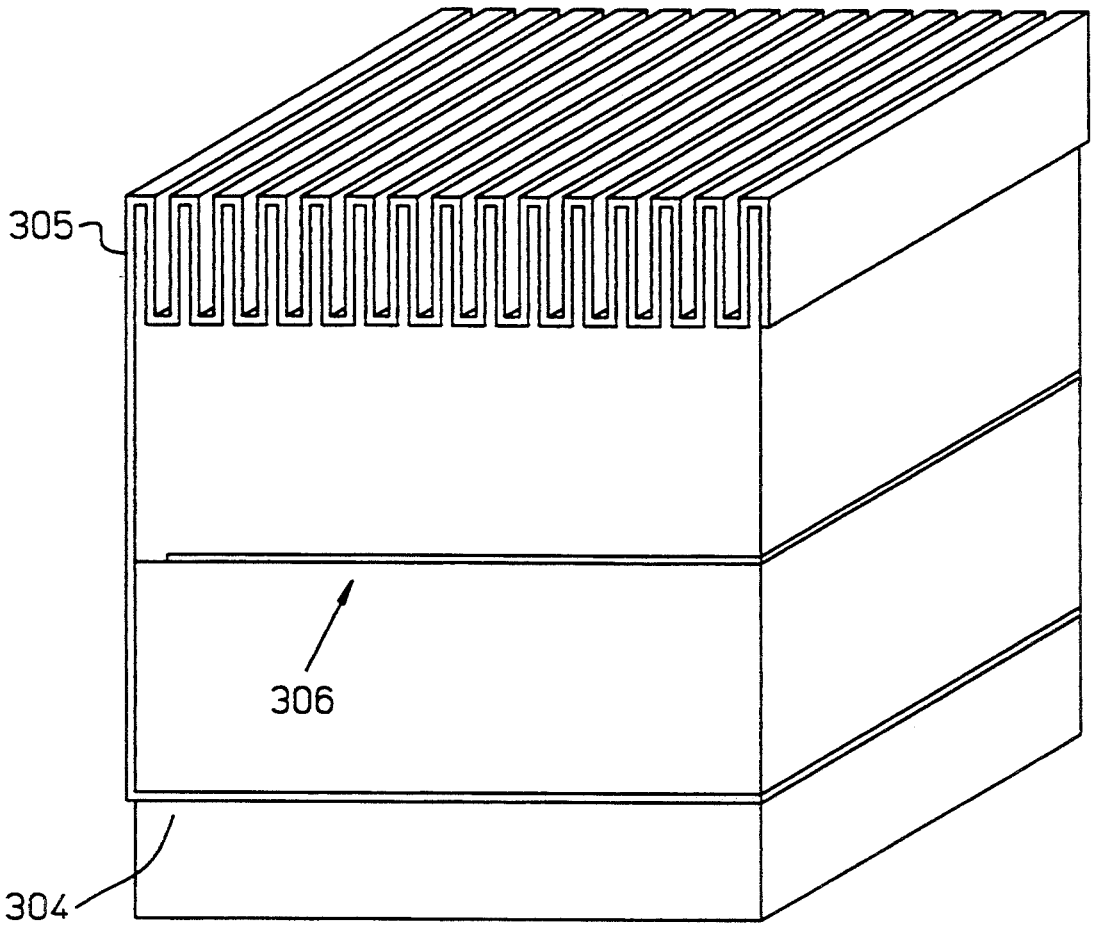

Metal electrode layers 305, 306 shown in FIG. 3C are deposited by sputtering. A first electrode layer 305 includes contiguous metal films formed in a modified "c" shape that wrap around the slab of the first piezoelectric material and a slab of the second piezoelectric material. Preferably, the second piezoelectric material is a modified relaxor ferroelectric ceramic such as PMN-PT. A top portion of the modified "c" shape is rippled because metal film of the first electrode layer extends into and contacts the grooves in the first face of the slab of the first piezoelectric material. A second electrode layer 306 is sandwiched between opposing surfaces of the slabs.

The first electrode layer includes metal film having a selected thickness between approximately 1000 to 3000 angstroms, which is sputtered onto the slab of the first piezoelectric material so as to extend into and contact the grooves. The second electrode layer includes similar metal film that is sputtered onto the opposing face of the slab of the first piezoelectric material. A mask stripe covers an edge portion of the opposing surface of the slab of the first piezoelectric material so that metal film is not deposited on the edge portion.

A preferred method is used to adhesively bond an opposing surface of a slab of the second piezoelectric material to the metal film sputtered onto the opposing surface of the slab of the first piezoelectric material. It is preferred that adhesive bonding employ a desired layer of epoxy composite that has a thickness sufficiently thin so as to be acoustically transparent to acoustic waves produced by the transducer. Accordingly, it is preferred thickness of the layer is less than one hundredth of a wave length of the acoustic signals.

In the preferred bonding method, a small amount of the epoxy composite is disposed on a first glass substrate. The epoxy composite includes a mixture of epoxy resin and particulates such as minute glass beads or minute particles of aluminum oxide, silver oxide, titanium oxide, or other suitable material. It is preferred that the particulates have a substantially spherical shape with a diameter of approximately half a micron. An amount of the particulate provides approximately five to ten percent volume fraction of the epoxy composite, while an amount of the epoxy resin provides a remainder of the epoxy composite.

The epoxy composite is first sandwiched between the first glass substrate and a second glass substrate. Sufficient pressure is applied to the first and second glass substrates so as to provide substantially uniform spreading of the epoxy composite. The second glass substrate is then separated from the epoxy composite so that epoxy composite remains coating the first glass substrate. The metal film sputtered onto the opposing surface of the slab of the first piezoelectric material is then pressed into contact with the epoxy composite coating. The first glass substrate is then separated from the epoxy composite coating so that the epoxy composite coating is transferred onto the metal film.

In a similar manner as described previously herein, another epoxy composite coating is transferred onto the opposing surface of the slab of the second piezoelectric material. The desired epoxy composite layer is produced by placing the slabs in a press and sandwiching the two epoxy coatings together between the opposing surface of the slab of the second piezoelectric material and metal film sputtered onto the opposing surface of the slab of the first piezoelectric material. The press provides sufficient pressure so as to squeeze the layer to the desired thickness. The particulates in the epoxy composite preserve integrity of the bond by preventing the thickness of the layer from becoming too thin. The slabs are left in the press for a sufficient time so as to allow curing of the epoxy composite, preferably ten to twelve hours. During curing, a suitable temperature is maintained, for example fifty degrees Fahrenheit. It should be understood that while the preferred adhesive bonding method has been discussed in detail herein, the invention is not strictly limited to embodiments employing the preferred adhesive bonding method. Alternative adhesive bonding methods well known to those with ordinary skill in the art may be used with beneficial results.

The first electrode layer referred to previously herein and shown in FIG. 3C further includes metal film that is sputtered onto a first surface of the slab of the second piezoelectric material. The first electrode layer further includes metal film that is sputtered onto a respective side surface of each of the slabs of the first and second piezoelectric materials. Accordingly, the first electrode layer is formed in the modified "c" shape to include metal film on the respective side surfaces as contiguous with metal film on the first surfaces of the slabs of the first and second piezoelectric materials. A slab of an acoustically damping support material 304 is adhesively bonded to the metal film sputtered onto the opposing surface of the slab of the second piezoelectric material.

A poling process comprises placing the slabs into a suitable oven, elevating a temperature of the slabs close to a Curie point of the first piezoelectric material, and then applying a very strong direct current, DC, electric field of approximately 20 kilovolts/centimeter across the first and second electrodes while slowly decreasing the temperature of the slabs below the Curie temperature of the first piezoelectric material. Because an electrical potential difference along the thickness of the inert piezoelectric layer including the grooves is only a small fraction of a total electrical potential difference between the electrodes, the inert piezoelectric layer substantially retains the random alignment of individual ferroelectric domains present in the raw piezoelectric material. Accordingly, the inert piezoelectric layer is only very weakly poled and remains electromechanically inert. The weak poling of the piezoelectric layer further helps to insure that the layer is electromechanically inert. In contrast, the poling process aligns a great majority of individual ferroelectric domains in the bulk remainder portion of the piezoelectric slab. Accordingly, the bulk remainder portion of the slab of the first piezoelectric material is very strongly poled and is electromechanically active.

The second piezoelectric material has a Curie temperature that is substantially different than that of the first piezoelectric material. For example, PMN has a Curie temperature that is substantially lower than that of PZT. The strong electric field is discontinued after the slabs cool below the Curie temperature of the first piezoelectric material, but before there would be any cooling of the slabs cool below the Curie temperature of the second piezoelectric material. In general, relaxor ferroelectric ceramics that are held above their Curie temperatures are substantially electromechanically active only while a D.C. electric field is applied thereto. Accordingly, when the D.C. electric field is discontinued at a sufficiently high temperature, the second piezoelectric material substantially returns to a state of random polarization and becomes substantially electromechanically inert.

Figure 3D:
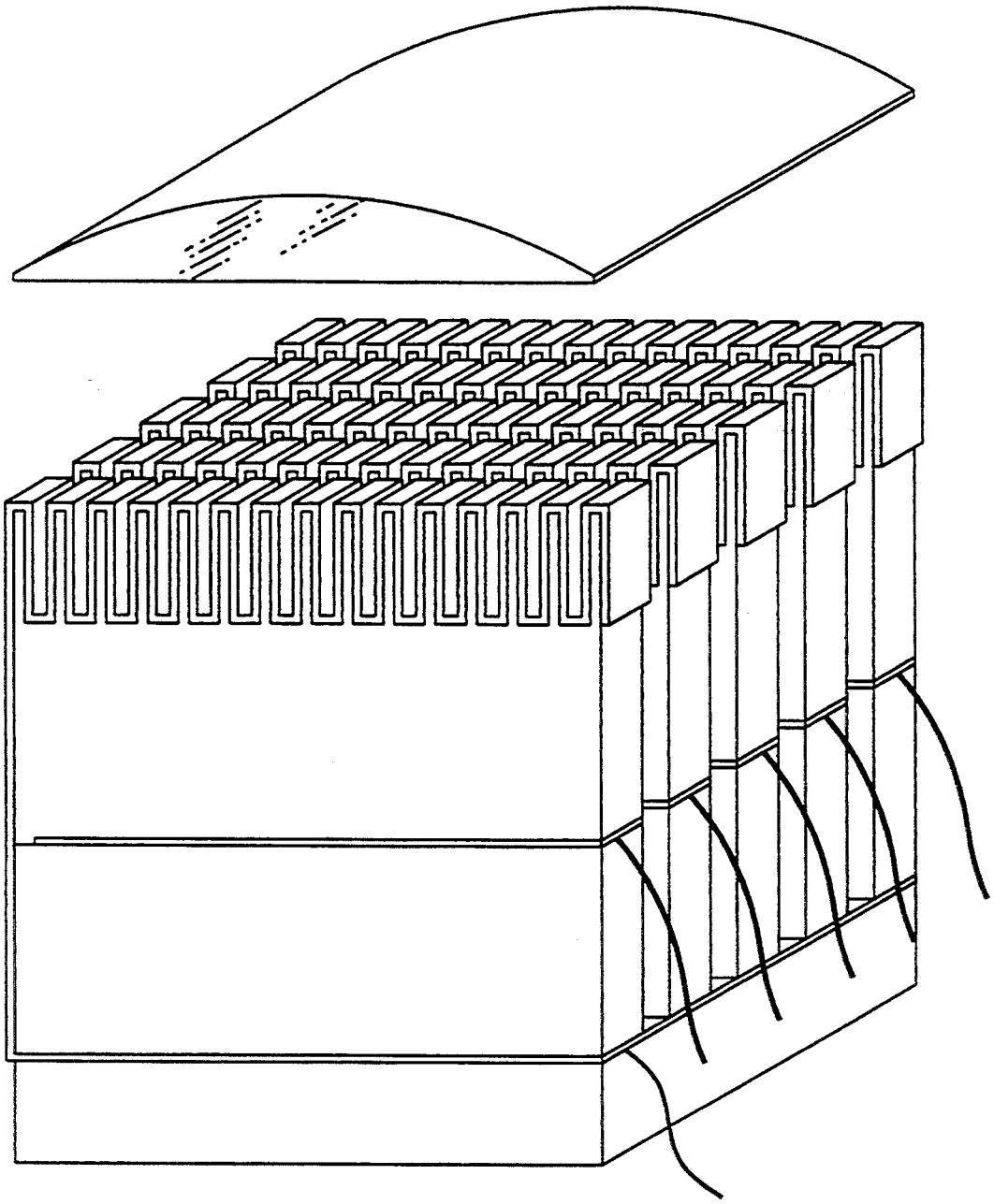

Conformal material is disposed in the grooves. As discussed previously herein, in the preferred embodiment the conformal material is a gas, such as air. In another preferred embodiment, the conformal material is a low density conformal solid, such as polyethylene. Conducting leads are electrically coupled to the metal films, as shown in FIG. 3D, using a wire bonding technique. Alternatively, the conducting leads may be electrically coupled to the metal films by a very thin layer of epoxy or by soldering. The dicing machine cuts entirely through the slabs of the first and second piezoelectric materials at regularly spaced locations to separate distinct transducer elements of the array. An acoustic lens shown in exploded view in FIG. 3D is cast from a suitable resin on the front face of the transducer elements.

By selecting arrangement and dimensions of the grooves disposed on the surface of the transducer element, desired acoustic properties of the piezoelectric ceramic layer are tailored to satisfy various acoustic frequency response requirements. Grooves having rectangular cross section are preferred for ease of manufacturing. However, in other embodiments, grooves having cross sections other than rectangularly shaped cross sections are preferred so that the grooves control impedance of the piezoelectric layer over an enhanced acoustic frequency range. These other preferred embodiments are made in a similar manner as discussed previously with respect to FIGS. 3A–D.

Figure 4:
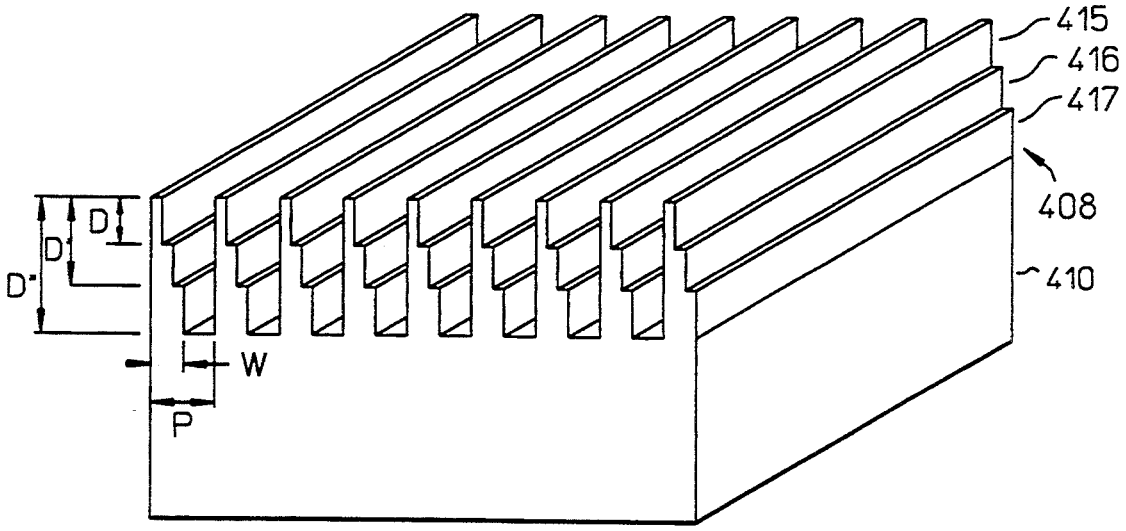
FIG. 4 illustrates another preferred embodiment of grooves employed in the invention.

For example, another preferred embodiment of the inert piezoelectric layer of the present invention is illustrated in FIG. 4. As in FIG. 3B discussed previously, FIG. 4 shows a slab of piezoelectric material having a inert piezoelectric layer 408 integral with the slab, grooves extending through the layer, and a bulk remainder portion 410 of the slab. In contrast to FIG. 3B discussed previously, the grooves of FIG. 4 include a first set of grooves 415, a second set of grooves 416, and third set of grooves 417 arranged adjacent to one another. As shown, the grooves are cut into the slab so that the grooves have a pitch, P, and a width, W. Each member of the first set of grooves is cut into the front face of the transducer element at a respective depth, D, which is approximately equal to an integral multiple of one quarter of a first wavelength of the acoustic signals. Similarly, each member of the second set of grooves has a respective depth dimension, D′, which is approximately equal to an integral multiple of one quarter of a second wavelength of the acoustic signals. Each member of a third set of grooves has a respective depth dimension, D″, which is approximately equal to an integral multiple of one quarter of a third wavelength of the acoustic signals. Respective members of the first, second and third set of grooves are arranged in a "stair step" pattern as shown in FIG. 4. A single conformal material can be deposited in each set of grooves. Alternatively, a different conformal material can be deposited in each set of grooves to achieve the desired frequency response. Sputtering, poling and dicing processes are then performed in a similar manner as discussed previously with respect to FIGS. 3C and 3D in order to complete alternative embodiment of the ultrasonic probe having enhanced frequency response.

Figure 5:
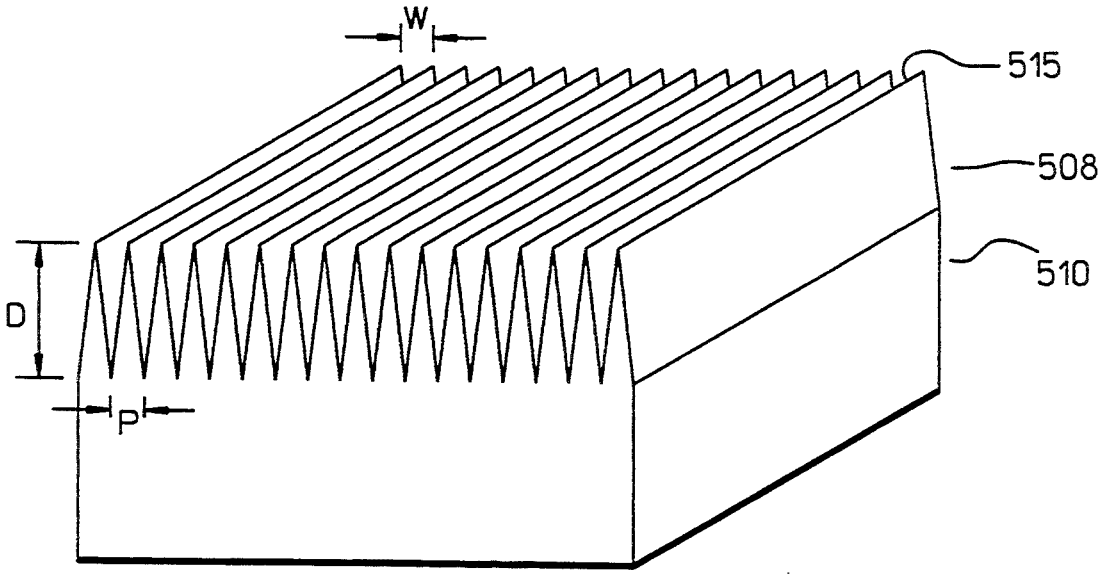
FIG. 5 illustrates yet another preferred embodiment of grooves employed in the invention.

In other alternative embodiments, a smoothed groove profile is etched, in place of the abrupt "stair step" pattern, to provide the transducer elements with enhanced acoustic performance such as impedance matching over an enhanced range of frequencies. For example, such alternative embodiments include grooves each having a smoothed "v" profile and extending into the front surface of the transducer element. Such alternative embodiments are made in a similar manner as discussed previously with respect to FIGS. 3A–D. For example, another alternative embodiment of the inert piezoelectric layer of the present invention is illustrated in FIG. 5. As in FIG. 3B discussed previously, FIG. 5 shows a slab of piezoelectric material having a inert piezoelectric layer 508 integral with the slab, grooves extending through the layer, and a bulk remainder portion 510 of the slab. In contrast to FIG. 3B discussed previously, the grooves of FIG. 5 include grooves 905 having a smoothed "v" profile. As shown, the grooves are etched into the slab so that the grooves have pitch, P, and width, W, and depth, D.

Figure 6A:
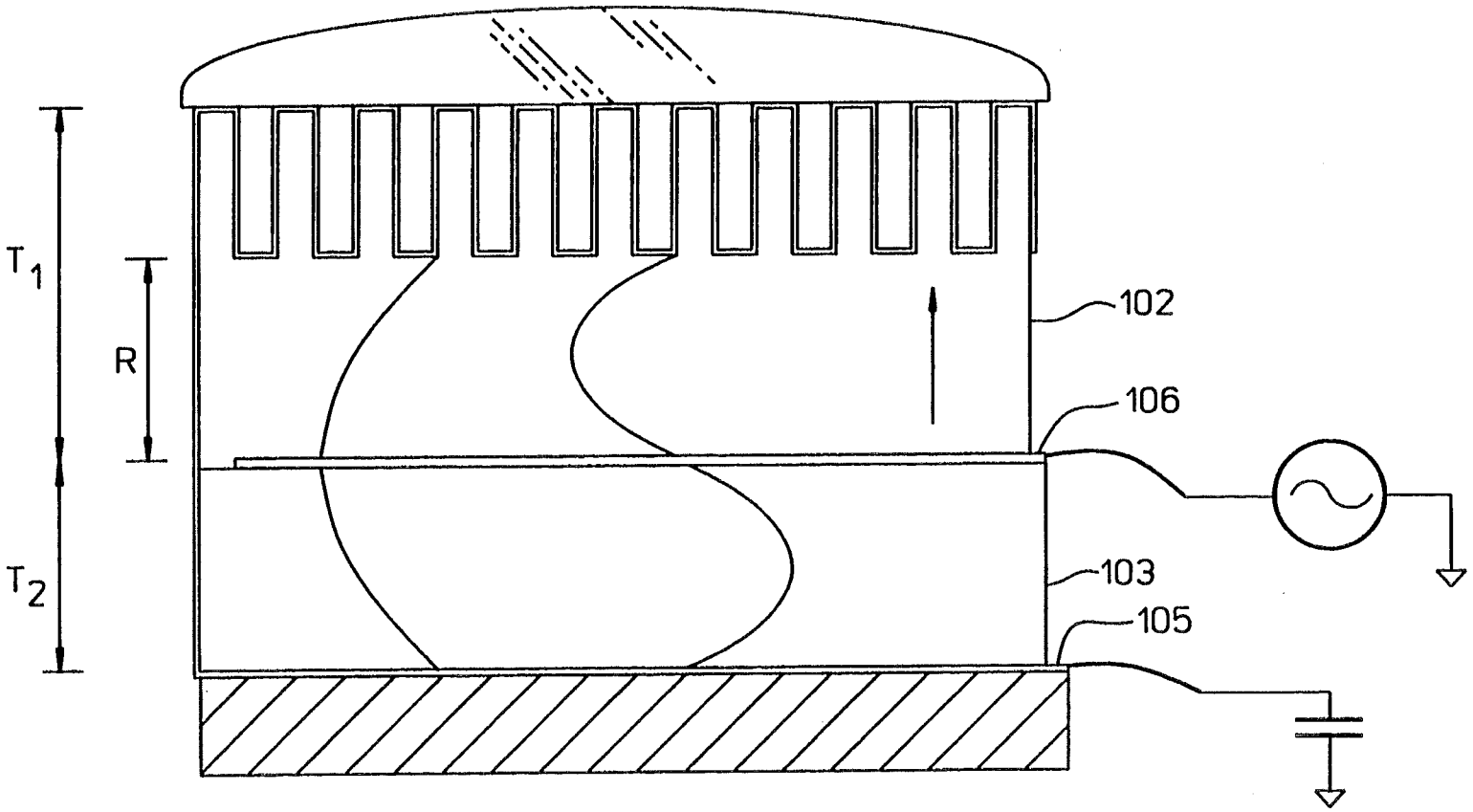
FIG. 6A is a simplified side view of a transducer element of the probe of the present invention.

FIG. 6A is a simplified side view of one of the transducer elements of the probe of the present invention. Though operation and tuning of the one transducer element shown in FIG. 6A is discussed in detail herein, it should be understood that the concepts discussed herein are generally applicable to the other transducer elements of the array. The preferred novel arrangement of electrodes electrically couple the bodies in parallel with one another. As shown in FIG. 6A, the first electrode layer 105 is capacitively coupled to ground. The second electrode layer 106 is sandwiched between the body of the first piezoelectric material 102 and the body of the second piezoelectric material 103.

An oscillating voltage source for exciting the acoustic signals in the transducer element of the probe is coupled with the electrodes. The oscillating voltage source has a first electrical lead coupled to the first electrode layer. The oscillating voltage source has a second electrical lead, shown as grounded in FIG. 6A, which is capacitively coupled to the second electrode layer.

The bulk remainder portion of the body of the first piezoelectric material is strongly poled and therefore is electromagnetically active. This strong poling is representatively illustrated by an arrow drawn within the body of the first piezoelectric material as shown in FIG. 6A. Accordingly, the body of the first piezoelectric material actively resonates in response to the oscillating voltage source. Without a D.C. bias voltage applied to the body of the second piezoelectric material, the body of the second piezoelectric material is randomly poled and is substantially electromechanically inert. Accordingly, the body of the second piezoelectric material passively resonates along with the body of the first piezoelectric material.

The thickness dimension $T_2$ of the body of the second piezoelectric material is selected to be approximately the same as the thickness dimension R of the bulk remainder portion of the body of the first piezoelectric material. As the body of the second piezoelectric material passively resonates in series with the body of first piezoelectric material, at least two resonance modes are supported by the transducer element. Two resonance modes are representatively illustrated in FIG. 6A by a sine wave and a half sine wave drawn as spanning the thickness dimension $T_2$ of the body of the second piezoelectric material and the thickness dimension R of the bulk remainder portion of the body of the first piezoelectric material.

Figure 6B:
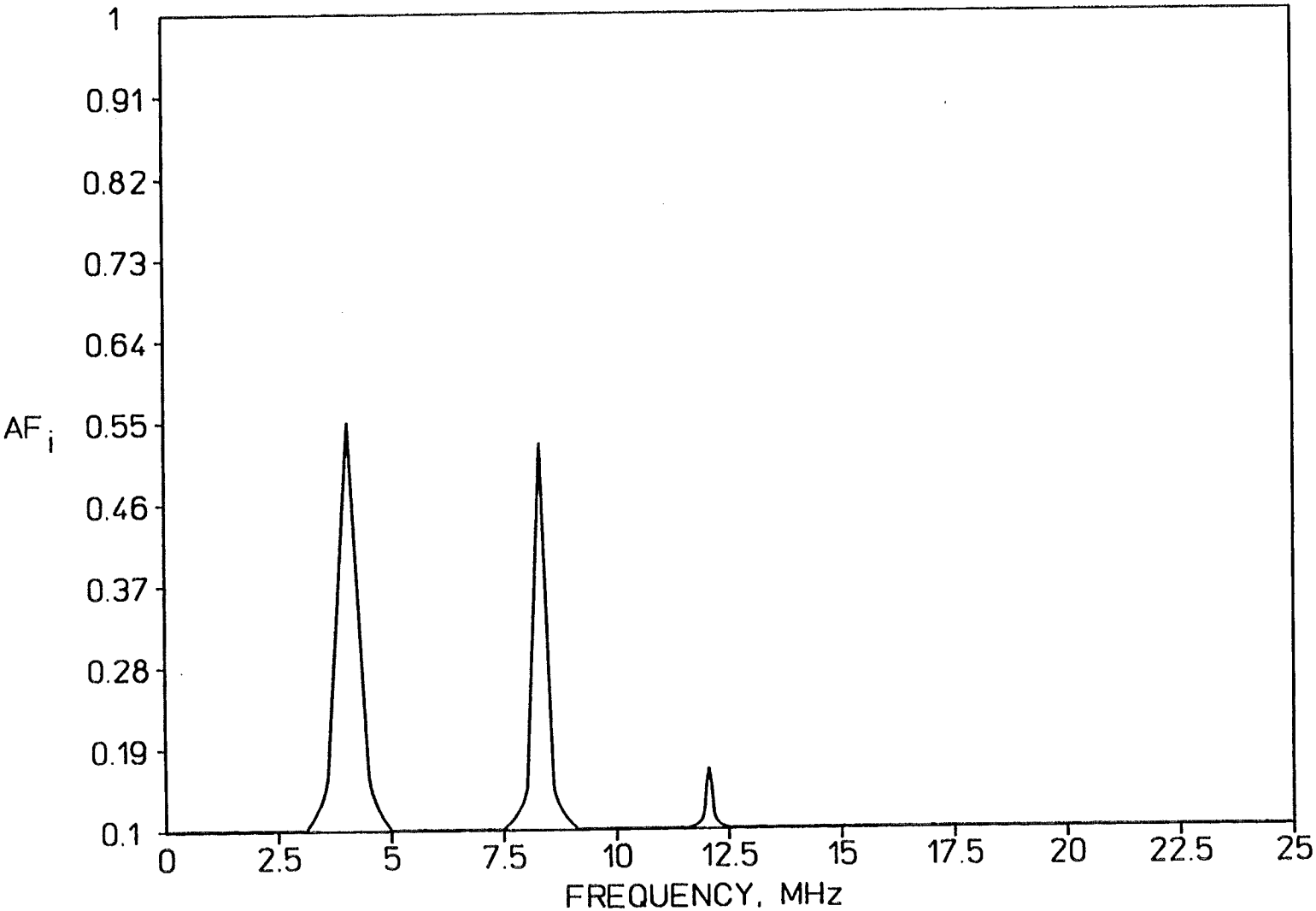
FIG. 6B is a graph illustrating resonance modes of the transducer element shown in FIG. 6A.

A first one of the resonance modes has a first frequency and a second one of the resonance modes has a second frequency. The first frequency is approximately twice the second frequency. FIG. 6B is a graph having spectral peaks representing the first and second resonance modes. As shown by spectral peaks, the two resonance modes have approximately equal intensity.

Figure 7A:
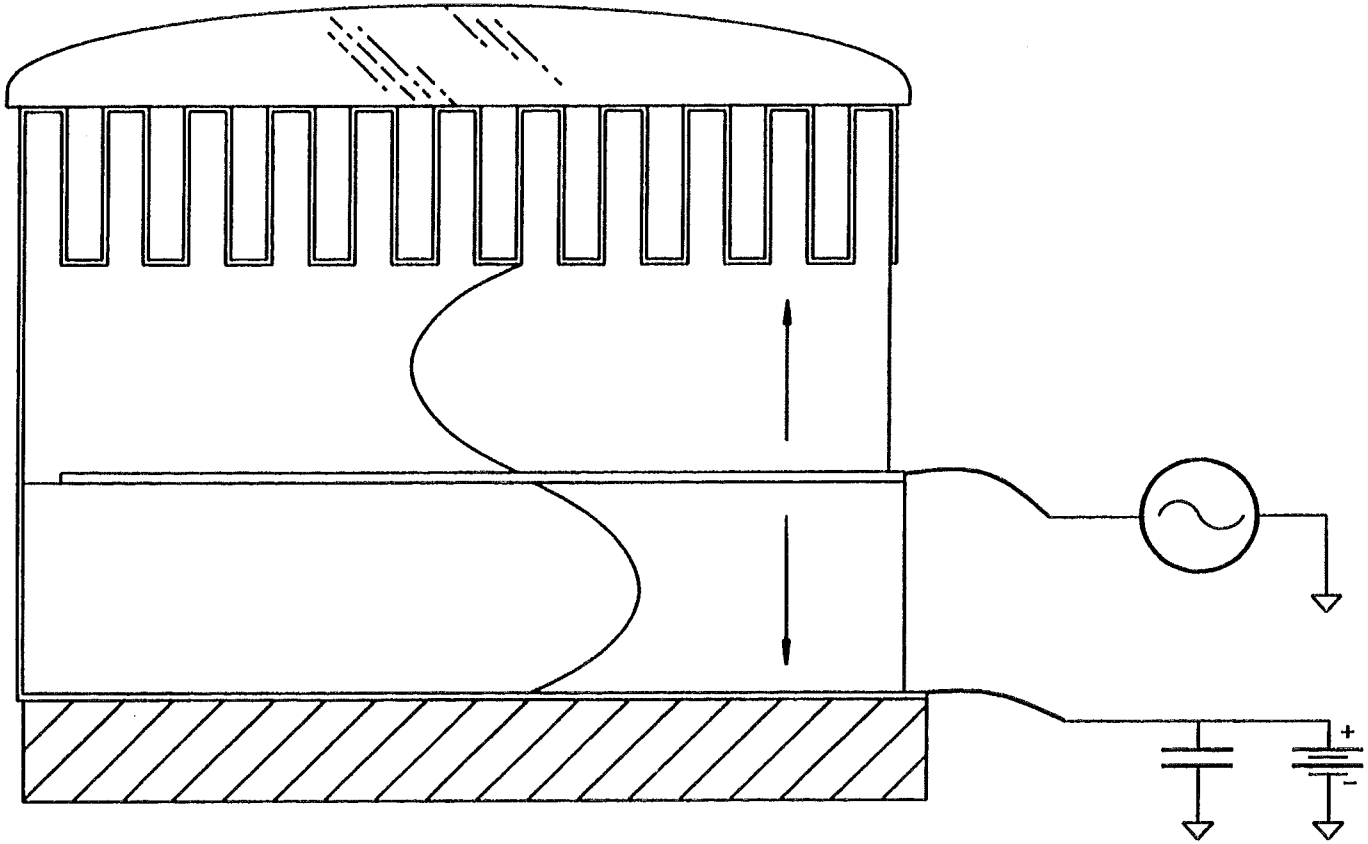
FIG. 7A is another simplified side view of the transducer element of the probe of the present invention.

FIG. 7A is another simplified side view of the transducer element. As indicated previously herein, the first piezoelectric material has a fixed polarization at the operating temperature of the probe. The polarization of the body of the first piezoelectric material is once again representatively illustrated by an arrow drawn within the body of the first piezoelectric material, as shown in FIG. 7A.

The second piezoelectric material has a polarization that is variable relative to the fixed polarization of the body of the first piezoelectric material. The polarization of the second piezoelectric material is variably controlled by a D.C. bias voltage applied by a bias voltage source coupled with the electrodes. As shown In FIG. 7A, the bias voltage source has a first electrical lead electrically coupled with the first electrode layer and a second electrode lead, shown as grounded, electrically coupled with the second electrode layer. Polarization of the body of the second piezoelectric material is representatively illustrated by an arrow drawn within the body of the second piezoelectric material as shown in FIG. 7A. It should be briefly noted that since polarization of the first piezoelectric material is fixed at the operating temperature of the probe, the bias voltage for controlling polarization of the second piezoelectric material has no substantial effect on the polarization of the first piezoelectric material.

Since the body of the first piezoelectric material is polarized, it is substantially electromechanically active. As indicated previously herein the body of the first piezoelectric material actively resonates in response to the oscillating voltage. Since the body of the second piezoelectric material becomes polarized under the influence of the bias voltage, it becomes substantially electromechanically active. Accordingly, under the influence of the bias voltage, the body of the second piezoelectric material also actively resonates in response to the oscillating voltage source.

The bias voltage source has a reversible electrical polarity for selecting one resonant frequency from a plurality of resonant frequencies of the probe. The bias voltage source is shown in FIG. 7A as having a negative polarity. In FIG. 7A the electrical polarity of the D.C. voltage source is selected so that direction of polarization of the body of the second piezoelectric material is substantially the same as the direction of polarization of the body of the first piezoelectric material. As illustrated in FIG. 7A, direction of the arrow representing polarization of the second piezoelectric material is substantially the same as the direction of the arrow representing polarization of the first piezoelectric material.

Figure 7B:
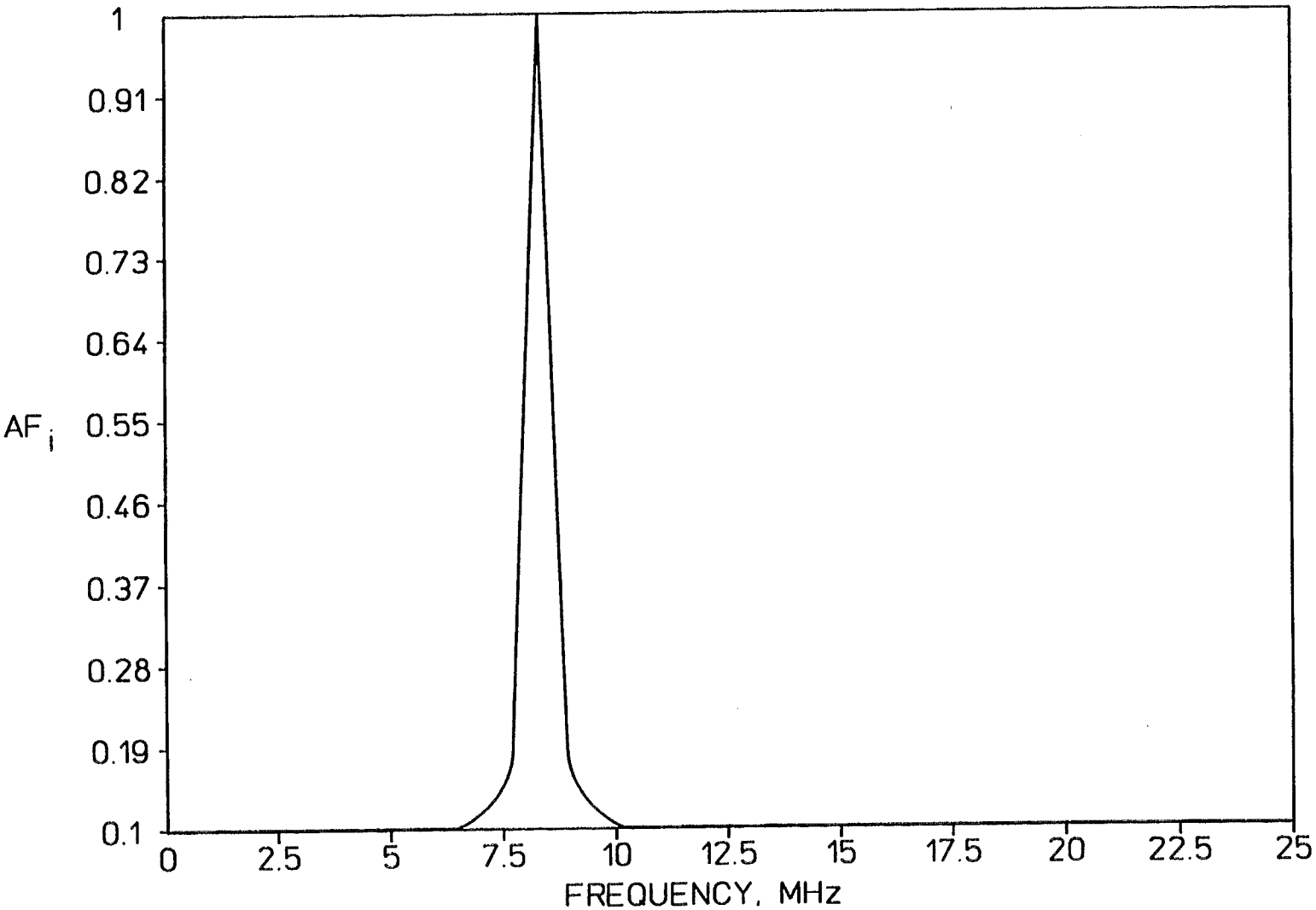
FIG. 7B is a graph illustrating a resonance mode of the transducer element shown in FIG. 7A.

The negative polarity of the bias voltage source shown in FIG. 7A is operative for selecting the first resonance mode of the transducer element, representatively illustrated by the sine wave drawn in FIG. 7A. FIG. 7B is a graph having a spectral peak representing the first resonance mode. As shown by comparing the spectral peak of FIG. 7B to the spectral peaks of FIG. 6B, the spectral peak of the selected resonance mode shown in FIG. 7B has approximately twice the intensity of the spectral peaks of the un-selected resonance modes shown in FIG. 6B. Such enhanced intensity is advantageous in medical ultrasonic imaging applications.

For the probe shown in FIG. 7A, the acoustic signals are generated by piezoelectric effects. Accordingly, mechanical forces are induced within each of the bodies of the first and second piezoelectric material by the oscillating voltage. Magnitude of the mechanical forces induced in each of the bodies is determined by a product of many factors including level of the oscillating voltage, capacitance of each of the bodies, and magnitude of polarization of each of the bodies. Since a magnitude of the polarization of the body of the second piezoelectric material is controlled by a level of the bias voltage, it should be understood that a magnitude of the mechanical force within the body of the second piezoelectric body is also controlled by the level of the bias voltage. The level of the bias voltage is adjusted using a preferred method so that the magnitude of the mechanical force within the body of the second piezoelectric material is substantially equal to the magnitude of the mechanical force within the body of the first piezoelectric material.

In the preferred method of adjusting the level of the bias voltage, resulting changes in the acoustic signals of the probe are monitored using a spectrum analyzer. The spectrum analyzer displays a maximum spectral peak of the selected mode when the bias voltage is adjusted so that the magnitude of the mechanical force within the body of the second piezoelectric material is substantially equal to the magnitude of the mechanical force within the body of the first piezoelectric material.

Figure 8A:
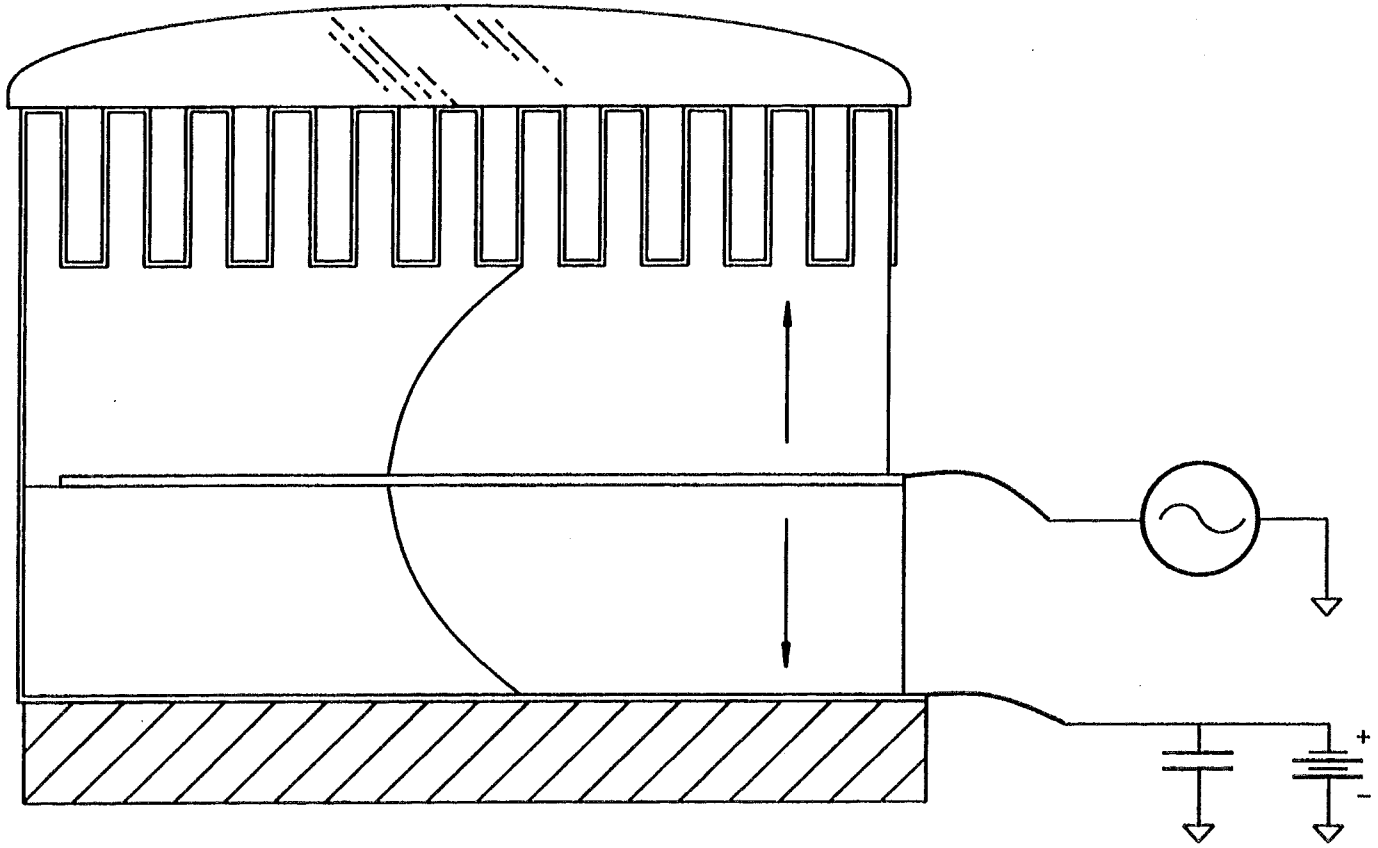
FIG. 8A is another simplified side view of the transducer element of the probe of the present invention.

FIG. 8A is another simplified side view of the transducer element. The polarization of the body of the first piezoelectric material is once again representatively illustrated by an arrow drawn within the body of the first piezoelectric material as shown in FIG. 8A. The polarization of the second piezoelectric material is variably controlled by the D.C. bias voltage applied by the bias voltage source.

As indicated previously, the electrical polarity of the bias voltage source is reversible. The bias voltage applied to the body of the second piezoelectric material is shown in FIG. 8A as having a positive polarity. Accordingly, the electrical polarity of the bias voltage source is reversed relative to that which was discussed previously herein with respect to FIG. 7A. Polarization of the body of the second piezoelectric material is representatively illustrated by an arrow drawn within the body of the second piezoelectric material as shown in FIG. 8A. As illustrated in FIG. 8A, direction of the arrow representing polarization of the second piezoelectric material opposes the direction of the arrow representing polarization of the first piezoelectric material.

Figure 8B:
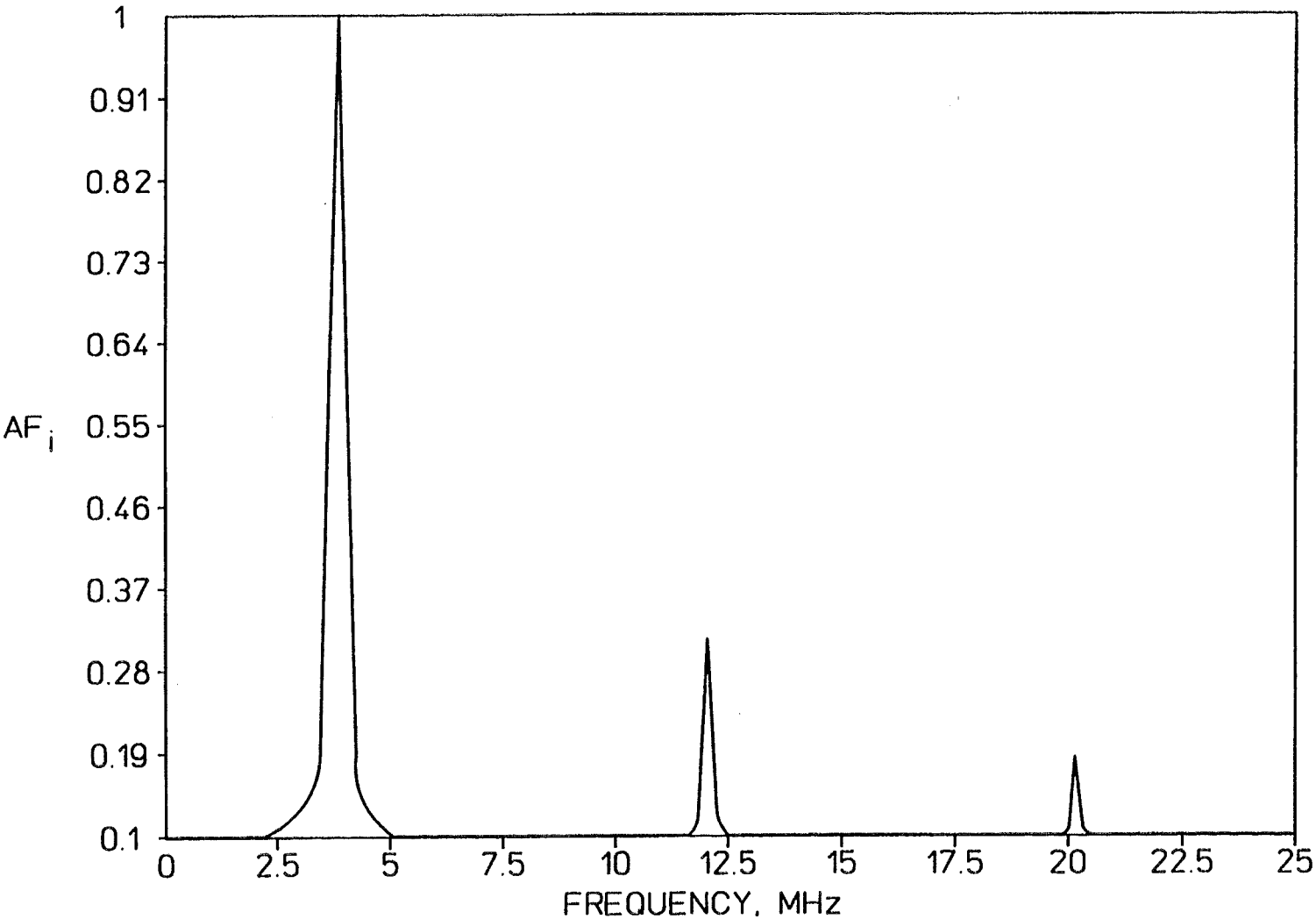
FIG. 8B is a graph illustrating a resonance mode of the transducer element shown in FIG. 8A.

The positive polarity of the bias voltage source shown in FIG. 8A is operative for selecting the second resonance mode of the transducer element, representatively illustrated by the half sine wave drawn in FIG. 8A. FIG. 8B is a graph having a spectral peak representing the second resonance mode. As shown by comparing the spectral peak of FIG. 8B to the spectral peaks of FIG. 6B, the spectral peak of the selected resonance mode shown in FIG. 8B advantageously has approximately twice the intensity of the spectral peaks of the un-selected resonance modes shown in FIG. 6B. The level of the bias voltage is adjusted as needed, maximizing the spectral peak of the selected resonance mode so that the magnitude of the mechanical force within the body of the second piezoelectric material is substantially equal to the magnitude of the mechanical force within the body of the first piezoelectric material.

In another preferred embodiment, the bias voltage source has a variable voltage level for selecting at least one of a plurality of resonant frequencies of the probe. The magnitude of the mechanical force within the body of the second piezoelectric material is varied relative to the magnitude of the mechanical force within the body of the first piezoelectric material. To provide further illustration, an exemplary probe comprising the body of PZT acoustically coupled in series with the body of PMN-PT was constructed and measured at various bias voltage levels.

The exemplary probe includes the first and second electrode layers arranged in accordance with the principles of the invention, however the acoustic impedance matching layer and damping support body were omitted for the sake of simplicity of construction. Measurements were made with only air loading the exemplary alternative probe. In the exemplary probe, the body of the first piezoelectric material has a thickness dimension of approximately 720 microns and the body of the second piezoelectric material has a thickness dimension of approximately 270 microns. Since the bodies of the first and second piezoelectric materials are acoustically coupled in series, the exemplary probe has a thickness dimension approximately equal to a sum of the thickness dimensions of the bodies of the first and second piezoelectric materials, approximately 990 microns. Impulse response and resonance modes of the exemplary probe were measured under impulse excitation at various D.C. bias voltage levels. Both magnitude and direction of polarization of the second piezoelectric material are varied by the D.C. bias voltage levels.

Figure 9A:
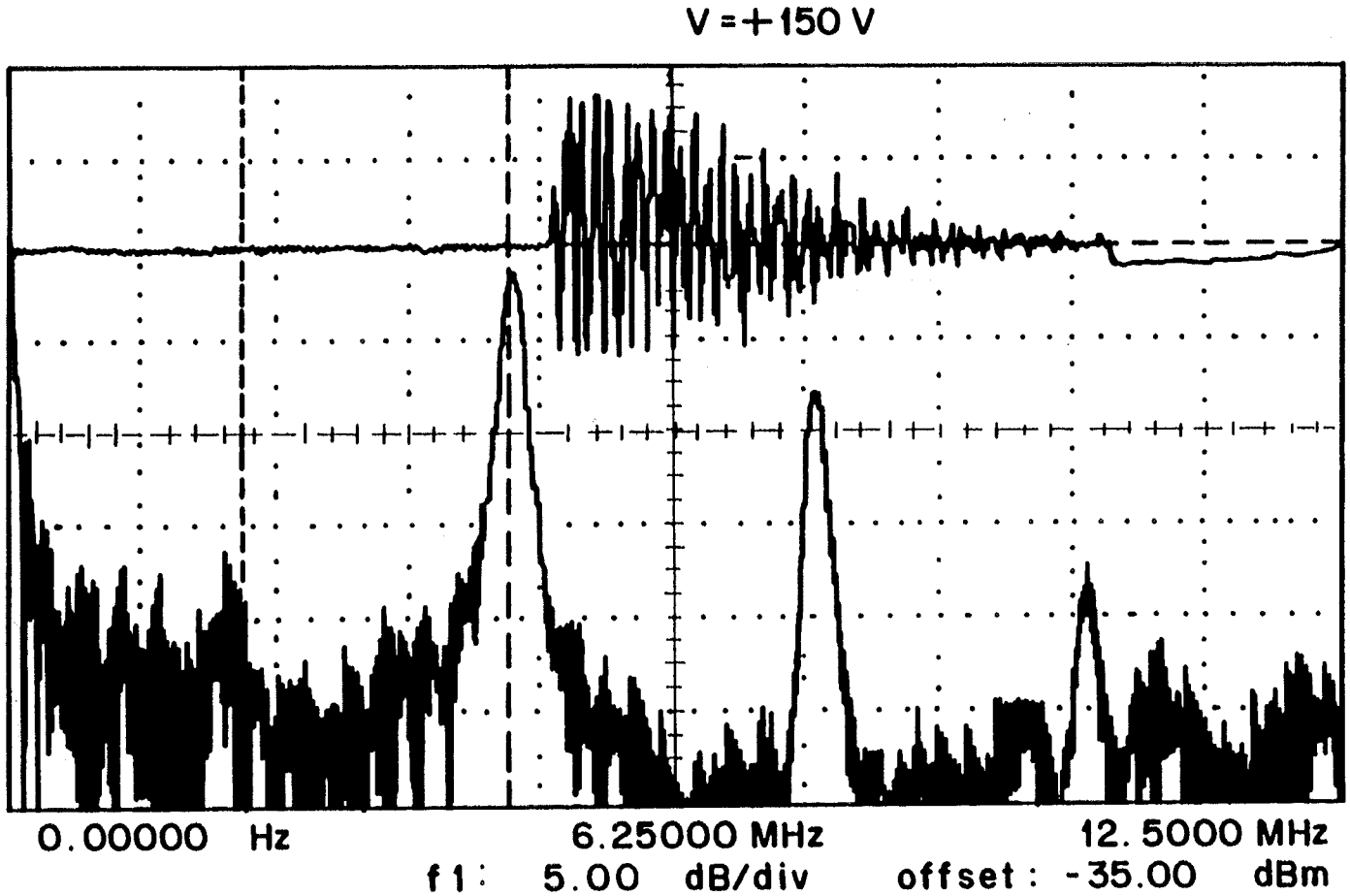
FIGS. 9A through 9E are graphs illustrating resonance modes of an exemplary embodiment of the probe of the present invention at various bias voltage levels.
Figure 9B:
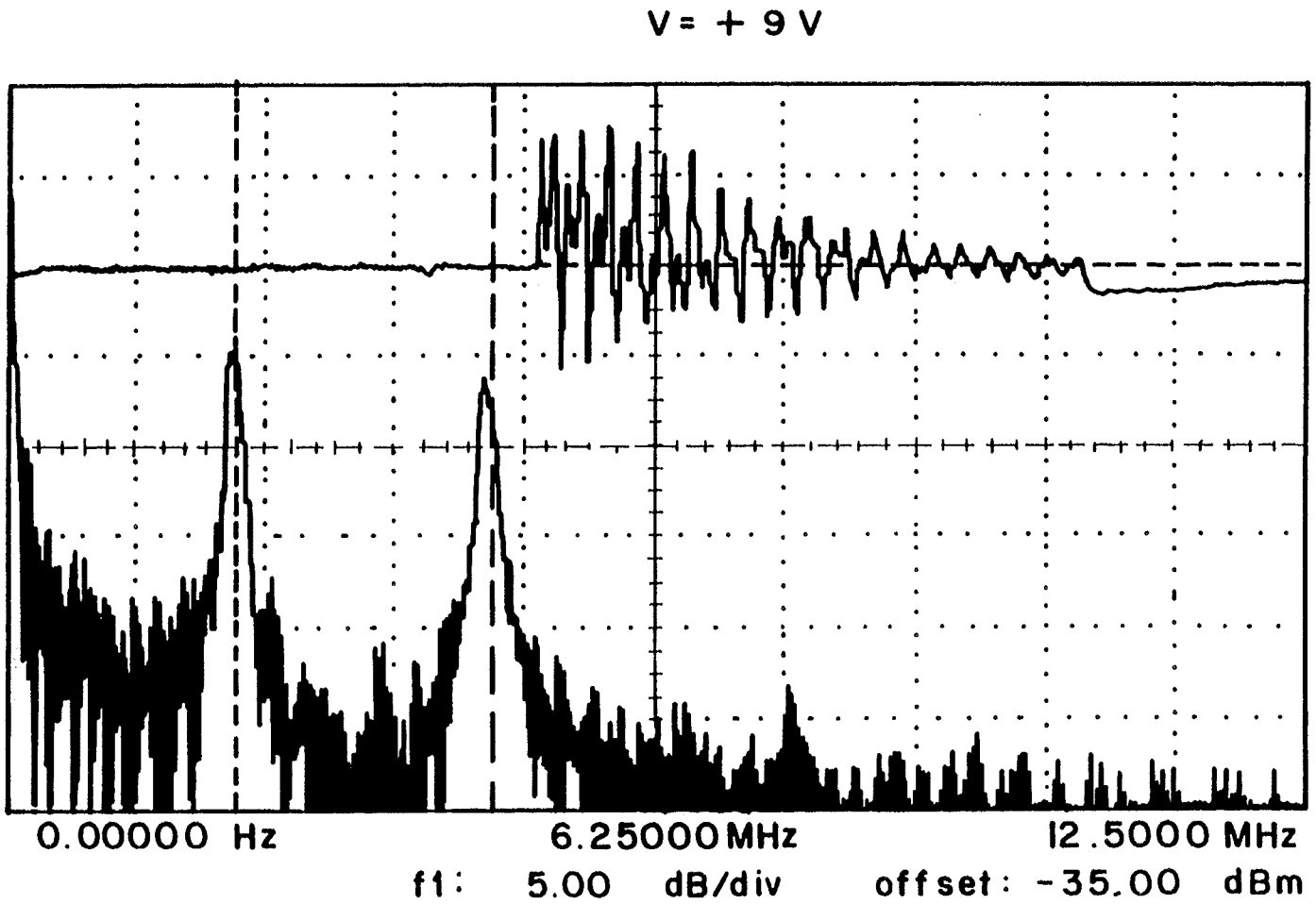
Figure 9C:
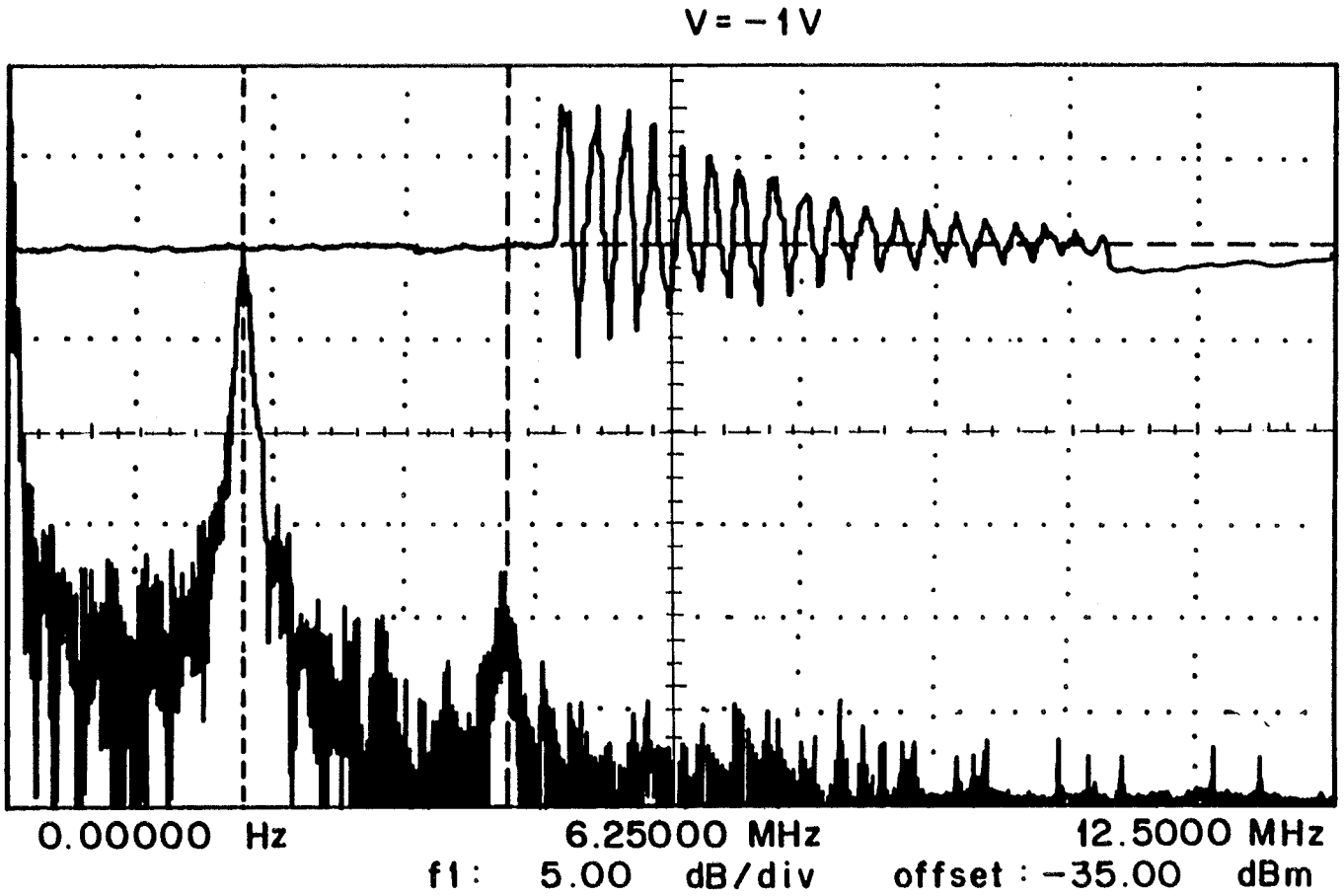
Figure 9D:
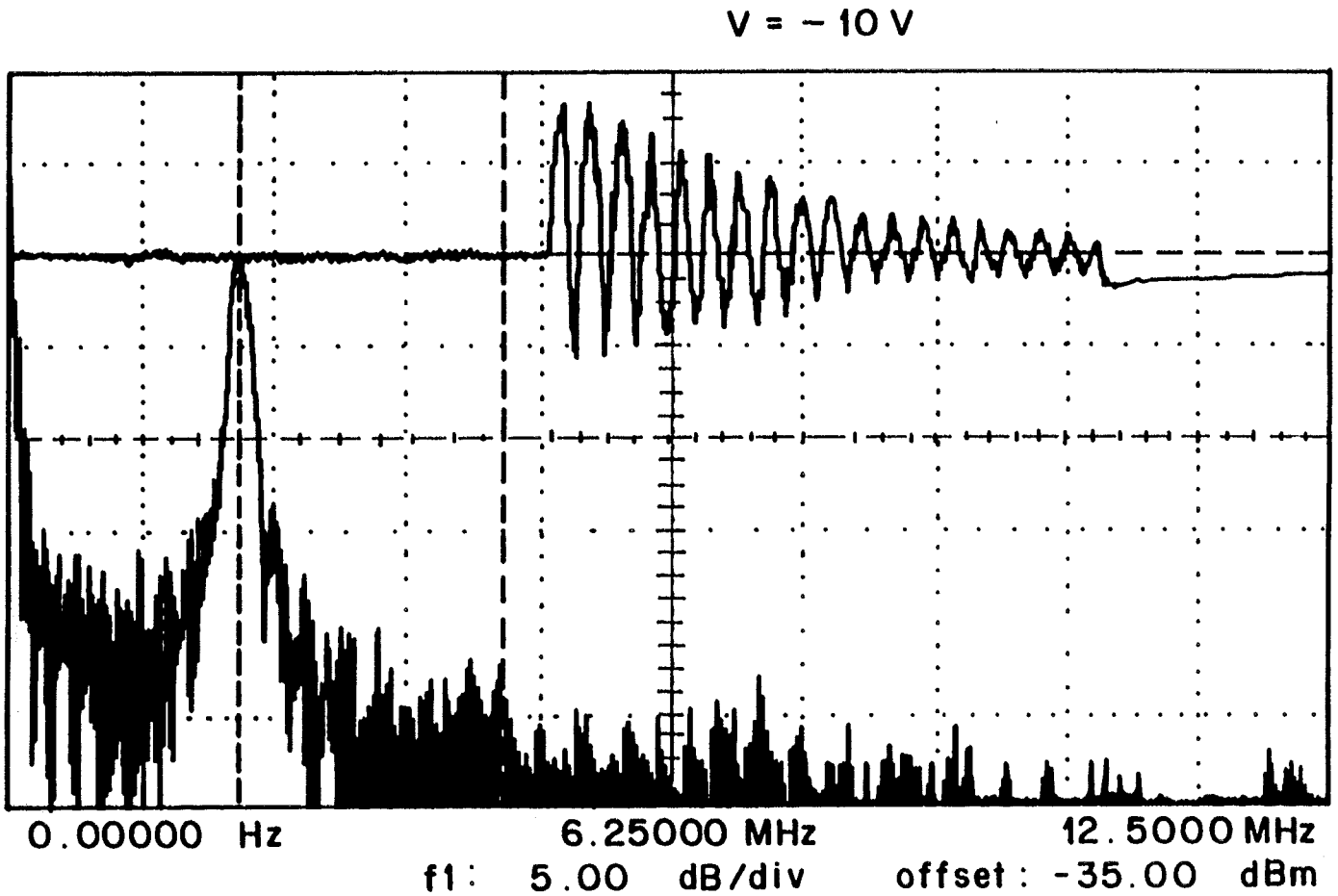
Figure 9E:
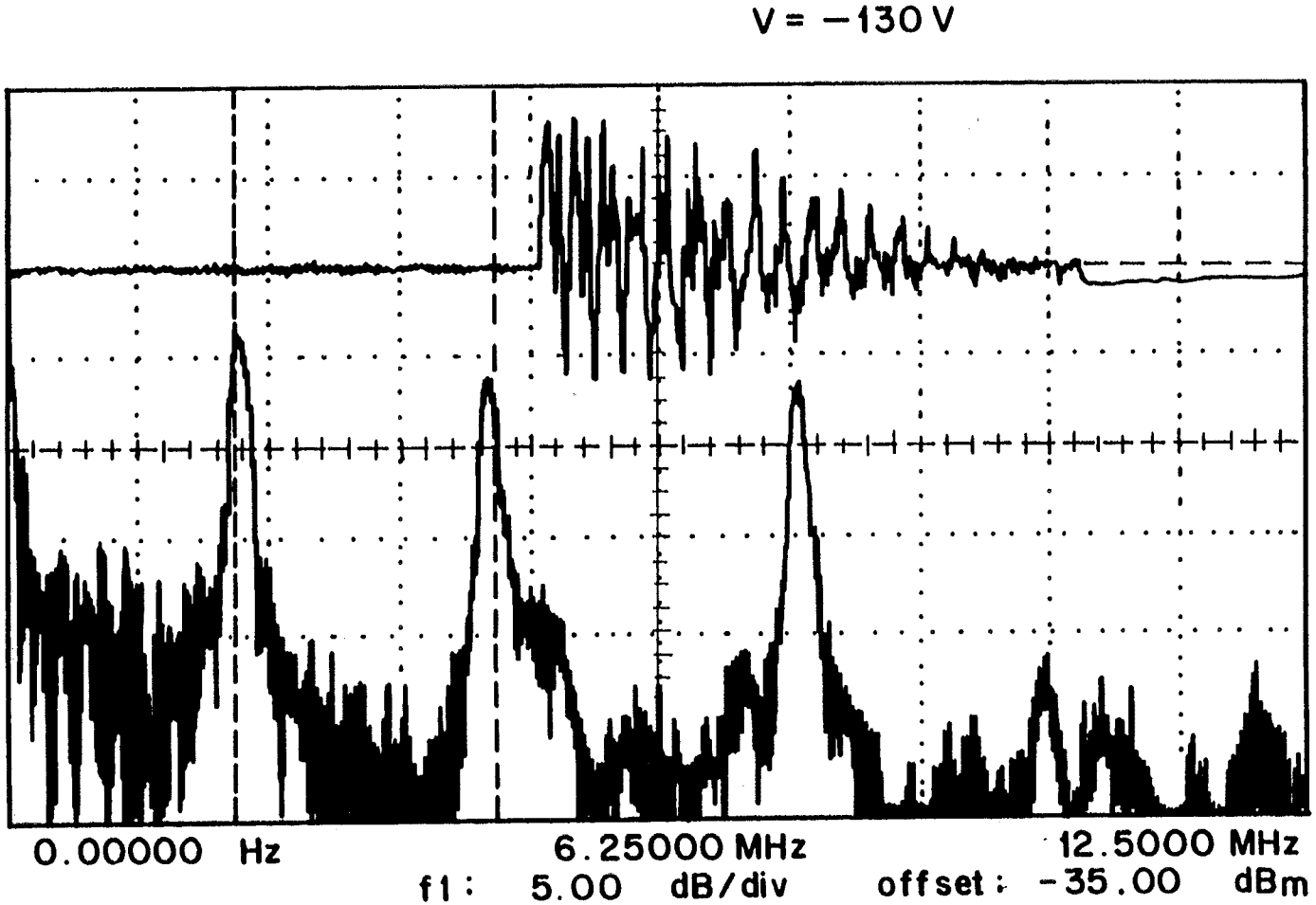

FIGS. 9A through E include measurement graphs illustrating impulse response and resonance modes of the exemplary probe under impulse excitation at various D.C. bias voltage levels. As shown, each of the D.C. bias voltage levels simultaneously tunes a plurality of resonant frequencies of the probe. The temporal impulse response is shown in a respective top portion of each of the graphs. Spectral peaks of resonance modes are shown in a respective bottom portion of each of the graphs. FIG. 9A illustrates impulse response and resonance modes at a bias level of 150 volts. FIG. 9B illustrates impulse response and resonance modes at a bias level of 9 volts. FIG. 9C illustrates impulse response and resonance modes at a bias level of −1 volts. FIG. 9D illustrates impulse response and resonance modes at a bias level of −10 volts. FIG. 9E illustrates impulse response and resonance modes at a bias level of −130 volts.

Alternative embodiments of the present invention include a probe generally similar to those illustrated in the figures and discussed previously herein, but further including one or more additional bodies of the first piezoelectric material acoustically coupled in series with the body of the second piezoelectric material. Preferably, thin adhesive layers are used to bond the bodies together. Alternatively, the ceramic bodies are bonded together by co-firing them in an oven at a sufficient temperature for a suitable period of time. The pair of electrode layers electrically couple the bodies in parallel with one another.

The plurality of bodies of the first piezoelectric material each have a respective fixed polarization directed along thickness dimensions of the bodies. The fixed polarizations have alternating directions so that any two adjacent members of the three bodies have opposing fixed polarization direction. Providing that the piezoelectric ceramic impedance matching layer is excluded from consideration, the preferred thickness dimension of body of the second piezoelectric material is approximately equal to a sum of respective thickness dimensions of each of the bodies of the first piezoelectric material.

In general, relaxor ferroelectric ceramics, such as PMN-PT have dielectric constants that are much higher than those of conventional piezoelectric ceramics, such as PZT. Accordingly, even though respective thickness dimensions of each of the bodies of the first piezoelectric material are generally less than or equal to thickness of the body of the second piezoelectric material, capacitance provided by the body of the second piezoelectric material is generally larger than capacitance provided by any one of the plurality of bodies of the first piezoelectric material. Since capacitances provided by the plurality bodies of the first piezoelectric material add in parallel, number and thickness of the bodies of the first piezoelectric material are advantageously selected so that a sum of capacitances provided by the bodies of the first piezoelectric material is approximately equal to the capacitance provided by the body of the second piezoelectric material.

Figure 10:
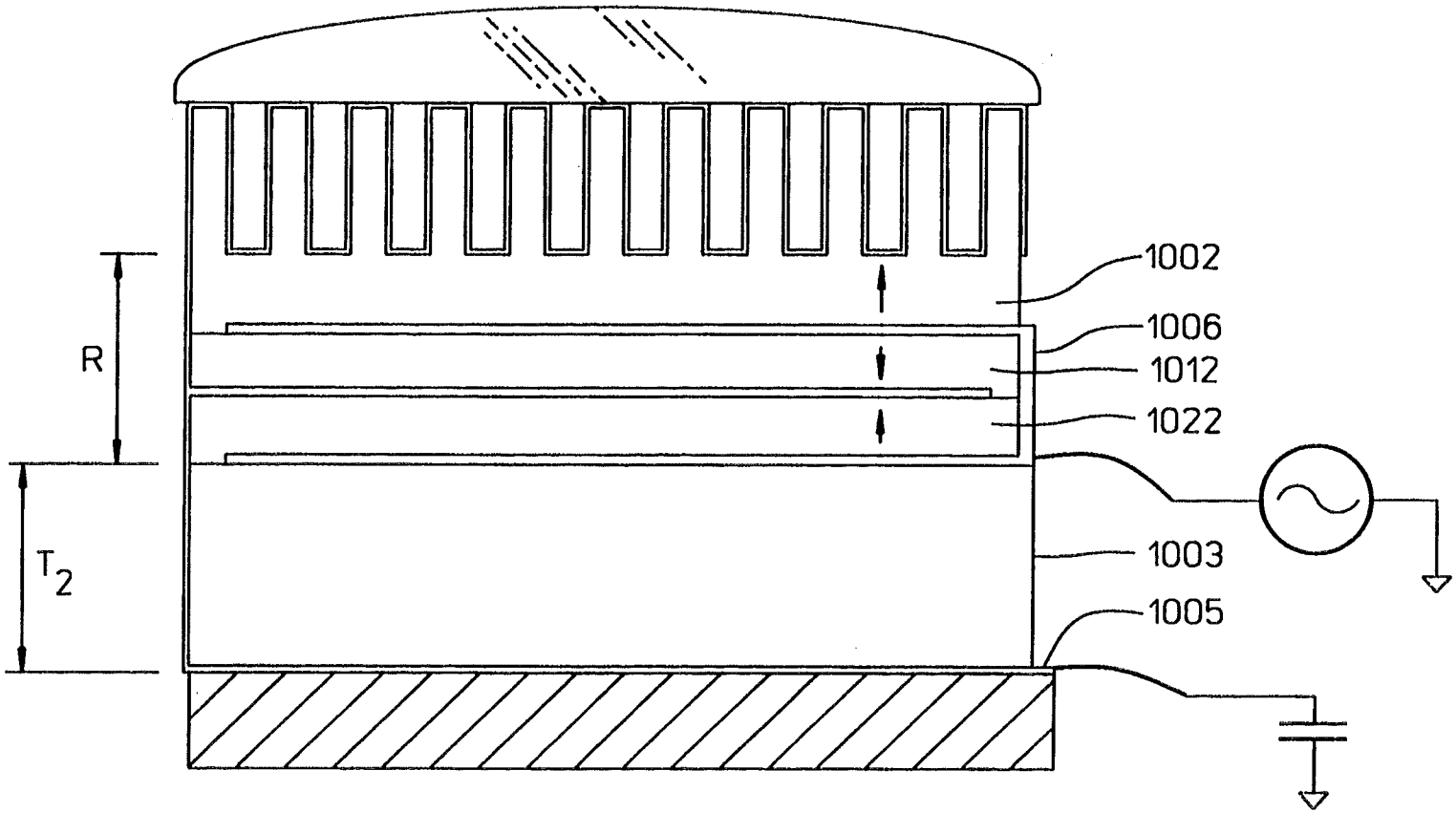
FIG. 10 is a simplified side view of an alternative embodiment of probe of the present invention.

For example, FIG. 10 shows a side view of the alternative embodiment of the probe of the present invention. FIG. 10 illustrates three bodies 1002, 1012, 1022, of the first piezoelectric material acoustically coupled in series with the body of the second piezoelectric material 1003. The three bodies of the first piezoelectric material have fixed polarization as representatively illustrated by arrows drawn within the three bodies in FIG. 10. As shown by the directions of the representative arrows in FIG, 10, direction of polarization of the three bodies is alternated so that any two adjacent members of the three bodies have opposing fixed polarization direction.

The pair of electrode layers 1005, 1006, electrically couple the bodies in parallel with one another as shown in FIG. 10. One of the three bodies of the first piezoelectric material 1002 has grooves extending through a piezoelectric ceramic impedance matching layer portion of the body. Neglecting consideration of the piezoelectric ceramic impedance matching layer, the preferred thickness dimension of body of the second piezoelectric material, $T_2$ is approximately equal to a sum, R, of respective thickness dimensions of the three bodies of the first piezoelectric material. Thickness of the three bodies of the first piezoelectric material are advantageously selected so that a sum of capacitances provided by the bodies of the first piezoelectric material is approximately equal to the capacitance provided by the body of the second piezoelectric material. A bias voltage source (not shown) is coupled to the electrodes for variably controlling polarization of the body of the second piezoelectric material, thereby tuning the probe.

The tunable ultrasonic probe of the present invention provides efficient acoustic coupling to a desired medium under examination by the probe and further provides for efficient electrical coupling of probe control lines to imaging system components. Although specific embodiments of the invention have been described and illustrated, the invention is not to be limited to the specific forms or arrangements of parts so described and illustrate, and various modifications and changes can be made without departing from the scope and spirit of the invention. Within the scope of the appended claims, therefore, the invention may be practiced otherwise than as specifically described and illustrated.

What is claimed is:

1. A tunable ultrasonic probe for coupling acoustic signals between the probe and a medium having an acoustic impedance, comprising:

a body of a first piezoelectric ceramic material having a Curie temperature;

a body of a second piezoelectric material acoustically coupled in series with the body of the first piezoelectric material, body of the second piezoelectric material having a polarization and further having a Curie temperature that is substantially different than that of the first piezoelectric material;

an electrode means for electrically coupling the bodies in parallel with one another and for applying a voltage potential to each of the bodies;

an oscillating voltage means for exciting the acoustic signals in the probe, the oscillating voltage means being coupled with the electrode means; and a bias voltage means for variably controlling the polarization of the second piezoelectric material, the bias voltage means being coupled with the electrode means.

2. A probe as in claim 1 wherein:

the body of the first piezoelectric material has a polarization that is fixed; and the polarization of the body of the second piezoelectric material is variable relative to the fixed polarization of the body of the first piezoelectric material.

3. A probe as in claim 1 wherein the bias voltage means for variably controlling the polarization of the second piezoelectric material includes a reversible polarity means for selecting one resonant frequency from a plurality of resonant frequencies of the probe.

4. A probe as in claim 1 wherein the bias voltage means for variably controlling the polarization of the second piezoelectric material includes a variable voltage level means for selecting at least one of a plurality of resonant frequencies of the probe.

5. A probe as in claim 1 wherein:

the body of the first piezoelectric ceramic material comprises a piezoelectric ceramic layer portion contiguous with a bulk remainder portion of the first piezoelectric ceramic material, the layer and the remainder each having a respective acoustic impedance; and the probe further comprises a means for controlling the acoustic impedance of the layer so as to substantially match the acoustic impedance of the remainder with the acoustic impedance of the medium.

6. A probe as in claim 5 wherein the means for controlling the acoustic impedance of the layer comprises grooves extending through the layer.

7. A probe as in claim 6 wherein the electrode means includes an electrode layer extending into and contacting the grooves.

8. A probe as in claim 1 wherein:

the body of the first piezoelectric ceramic material comprises a piezoelectric ceramic layer portion contiguous with a bulk remainder portion of piezoelectric ceramic material, the layer and the remainder each having a respective acoustic impedance; and the probe further comprises a means for controlling the acoustic impedance of the layer at a plurality of tunable resonant frequencies of the probe so as to substantially match the acoustic impedance of the remainder with the acoustic impedance of the medium.

9. A probe as in claim 1 wherein the Curie temperature of the second piezoelectric material is substantially lower than that of the first piezoelectric material.

10. A probe as in claim 9 wherein the Curie temperature of the second piezoelectric material is below approximately sixty degrees celsius.

11. A probe as in claim 9 wherein the Curie temperature of the second piezoelectric material is within a range from approximately twenty five degrees celsius to approximately forty degrees celsius.

12. A probe as in claim 1 wherein:

the first piezoelectric material has a dielectric constant; and the second piezoelectric material has a dielectric constant that is substantially higher than that of the first piezoelectric material.

13. A probe as in claim 1 wherein:

the body of the first piezoelectric material has a first face and an opposing face;

the body of the second piezoelectric material has a first face and an opposing face;

the electrode means includes a first electrode layer contacting the first face of the body of the first piezoelectric material and contacting the first face of the body of the second piezoelectric material; and the electrode means further includes a second electrode layer sandwiched between the opposing face of the body of the first piezoelectric material and the opposing face of the body of the second piezoelectric material.

14. A probe as in claim 13 wherein:

the oscillating voltage means has a first electrical lead coupled to the first electrode layer and has a second electrical lead capacitively coupled to the second electrode layer; and the bias voltage means for variably controlling the polarization of the second piezoelectric material has a first electrical lead coupled with the first electrode layer and has a second electrical lead coupled with the second electrode layer.

15. A probe as in claim 1 wherein:

the body of the first piezoelectric material has a thickness dimension;

the body of the second piezoelectric material has a thickness dimension; and the thickness dimension of the body of the second piezoelectric material is substantially different from that of the body of the first piezoelectric material.

16. A probe as in claim 15 wherein the probe further comprises a plurality of bodies of the first piezoelectric material acoustically coupled in series with the body of the second piezoelectric material.

17. A probe as in claim 16 wherein:

the bodies of the first piezoelectric material each have a respective capacitance;

the body of the second piezoelectric material has a capacitance; and the capacitance of the body of the second piezoelectric material is approximately equal to a sum of the respective capacitances of bodies of the first piezoelectric material.

18. A probe as in claim 1 wherein:

the first piezoelectric material is characterized by a first acoustic velocity of the acoustic signals as they propagate through the first piezoelectric material;

the second piezoelectric material is characterized by a second acoustic velocity of the acoustic signals as they propagate through the second piezoelectric material; and the second acoustic velocity is approximately the same as the first acoustic velocity.

19. A probe as in claim 1 further comprising a damping support body acoustically coupled in series with the body of the second piezoelectric material for damping unwanted acoustic signals and for drawing unwanted heat away from the body of the second piezoelectric material.

20. A tunable ultrasonic probe comprising:

a body of a first piezoelectric material having a fixed polarization;

a body of a second piezoelectric material acoustically coupled in series with the body of the first piezoelectric material, the second piezoelectric material having a polarization that is variable relative to the fixed polarization of the body of the first piezoelectric material;

an electrode means for electrically coupling the bodies in parallel with one another and for applying a voltage potential to each of the bodies;

an oscillating voltage means for exciting the acoustic signals in the probe, the oscillating voltage means being coupled with the electrode means; and a bias voltage means for controlling the variable polarization of the second piezoelectric material.

* * * * *